US008261933B2

(12) United States Patent
Kidd et al.

(10) Patent No.: US 8,261,933 B2
(45) **Date of Patent: *Sep. 11, 2012**

(54) CONTAINER

(75) Inventors: Allen Kidd, Placentia, CA (US); Stephen P. Zapatka, Kingston, IL (US)

(73) Assignee: Peninsula Packaging, LLC, Exeter, CA (US)

( * ) Notice: Subject to any disclaimer, the term of this patent is extended or adjusted under 35 U.S.C. 154(b) by 607 days.

This patent is subject to a terminal disclaimer.

(21) Appl. No.: 12/422,840

(22) Filed: Apr. 13, 2009

(65) Prior Publication Data

US 2009/0223966 A1 Sep. 10, 2009

Related U.S. Application Data

(63) Continuation-in-part of application No. 11/946,349, filed on Nov. 28, 2007.

(51) Int. Cl.
*B65D 43/22* (2006.01)
*B65D 43/16* (2006.01)

(52) U.S. Cl. ..... 220/835; 220/4.23; 220/788; 220/839; 220/324

(58) Field of Classification Search ..... 220/788, 220/4.23, 833, 834, 835, 839, 324
See application file for complete search history.

(56) References Cited

U.S. PATENT DOCUMENTS

| | | | | |
|---|---|---|---|---|
| 3,351,227 | A * | 11/1967 | Collie | 220/788 |
| 3,351,270 | A * | 11/1967 | Hohnjec | 220/835 |
| 3,356,277 | A | 12/1967 | Hohnjec | |
| 3,421,682 | A | 1/1969 | Eisenbacli et al. | |
| 3,933,296 | A | 1/1976 | Ruskin et al. | |
| 4,494,650 | A * | 1/1985 | Cullen | 206/315.9 |
| 4,512,474 | A | 4/1985 | Harding | |
| 4,576,330 | A * | 3/1986 | Schepp | 220/315 |
| 4,886,204 | A | 12/1989 | Kalmanides | |
| 5,046,659 | A | 9/1991 | Warburton | |
| 5,156,267 | A * | 10/1992 | Yates et al. | 206/364 |
| 5,169,014 | A | 12/1992 | Hexamer | |
| 5,497,894 | A * | 3/1996 | Krupa et al. | 220/4.23 |
| 5,584,408 | A | 12/1996 | Orkisz | |
| D382,795 | S | 8/1997 | Abayhan et al. | |
| 5,979,687 | A | 11/1999 | Hayes et al. | |
| 6,666,348 | B2 | 12/2003 | Fore et al. | |
| 7,204,388 | B2 | 4/2007 | Galland et al. | |

(Continued)

FOREIGN PATENT DOCUMENTS

| | | |
|---|---|---|
| CL | 5638 | 9/2007 |

(Continued)

*Primary Examiner* — Mickey Yu
*Assistant Examiner* — Niki Eloshway
(74) *Attorney, Agent, or Firm* — Loza & Loza LLP; Heidi Eisenhut

(57) ABSTRACT

A container for packaging food for transporting and selling to consumers is provided. The container includes a base having a pair of inwardly recessed pockets for capturing a pair of extending latching portions on a lid. The pair of extending latching portions has concave grooves allowing the extending latching portions to flex inwards from an initial position for insertion into the pair inwardly recessed pockets. When the pair of extending latching portions are inserted into the pair inwardly recessed pockets, the pair of extending latching portions expand back to their initial position and protrusions within the pair of inwardly recessed pockets retain the pair of extending latching portions creating a tight fit and preventing the lid of the container from being easily disengaged from the base of the container.

15 Claims, 20 Drawing Sheets

U.S. PATENT DOCUMENTS

| | | | | |
|---|---|---|---|---|
| D569,243 | S | 5/2008 | Kidd et al. | |
| 7,597,206 | B2 | 10/2009 | Atkins et al. | |
| 7,819,279 | B2 | 10/2010 | Galland et al. | |
| 2003/0152670 | A1 | 8/2003 | Shih | |
| 2003/0192888 | A1 | 10/2003 | Chang | |
| 2005/0247709 | A1 * | 11/2005 | Atkins et al. | 220/4.23 |
| 2006/0289550 | A1 | 12/2006 | Guardigli | |
| 2007/0045631 | A1 | 3/2007 | Endo et al. | |
| 2007/0095848 | A1 * | 5/2007 | Galland et al. | 220/784 |
| 2008/0023472 | A1 * | 1/2008 | Brandt | 220/4.23 |
| 2009/0134179 | A1 | 5/2009 | Kidd et al. | |
| 2009/0134180 | A1 | 5/2009 | Kidd et al. | |
| 2009/0223966 | A1 | 9/2009 | Kidd et al. | |

FOREIGN PATENT DOCUMENTS

| | | |
|---|---|---|
| EP | 1336569 | 8/2003 |
| EP | 1529077 | 5/2005 |
| FR | 2691701 | 12/1993 |

* cited by examiner

CONTAINER

CROSS-REFERENCE TO RELATED APPLICATIONS

This application is a continuation-in-part application of U.S. non-provisional application Ser. No. 11/946,349 filed Nov. 28, 2007 and entitled "CONTAINER".

FIELD

The present invention relates to the field of containers, in particular, to containers having locking mechanisms for preventing unauthorized access to contents of the containers.

BACKGROUND

It is common to use clear hinged containers to transport and package fresh and chilled foods, including but not limited to fruit, vegetables and bakery items, for selling to consumers. The containers allow the food to be transported with less damage, such as bruising, and provide convenient packaging for consumers who are purchasing the food.

However, the closing mechanisms on prior art containers can be easily opened. As a result, consumers can easily open the containers in the store prior to sale allowing them to sample the food without buying it and in some instances damaging the food such that it cannot be sold and has to be thrown away. Furthermore, the lack of a tight fitting closing or locking mechanism could allow the lid of a container to easily separate from its base during distribution and transportation allowing its contents to spill out damaging the food and ultimately having to be thrown out resulting in lost revenues for the grower.

Consequently, a container is needed that has an improved locking mechanism that can be easily closed by food packers/processors, either by hand or by automatic filling/closing machinery, yet be difficult for consumers to easily open prior to purchase and prevents the lid from separating from the base during transportation.

SUMMARY OF THE PRESENT INVENTION

In one embodiment a container for packaging food for transporting and selling to consumers is provided. The container includes a base having a pair of inwardly recessed pockets for capturing a pair of extending latching portions on a lid. The pair of extending latching portions has concave grooves allowing the extending latching portions to flex inwards from an initial position for insertion into the pair of inwardly recessed pockets. When the pair of extending latching portions are inserted into the pair of inwardly recessed pockets, the pair of extending latching portions expand back to their initial position and protrusions within the pair of inwardly recessed pockets retain the pair of extending latching portions, creating a tight fit and preventing the lid of the container from being easily disengaged from the base of the container during transport or prior to sale.

The inwardly recessed pockets may include a plurality of vertical pillars creating side gussets. The plurality of vertical pillars may extend in a generally upwardly direction from a bottom surface of the inwardly recessed pockets strengthening the pockets. The pillars may be formed integrally with the inwardly recessed pocket. In one embodiment, each of the inwardly recessed pockets may include six (6) pillars, two (2) located on the end portions of the pockets and two (2) located on each side of the pockets.

In another embodiment, the container may only have one locking mechanism or may have more than two locking mechanisms. In other words, the base may have one or more than two inwardly recessed pockets for capturing the one or more than two extending latching portions on the lid.

The foregoing, together with other features and advantages of the present invention, will become more apparent when referring to the following specification, claims and accompanying drawings.

BRIEF DESCRIPTION OF THE DRAWINGS

Various features of the present invention will be better understood from the following detailed description of an exemplary embodiment of the invention, taken in conjunction with the accompanying drawings in which like reference numerals refer to like parts.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "container" refers to any type of device for holding objects, including a receptacle, a bin, a box, a carton, a case, and a crate. The term "food" refers to any type of edible substance including all types of fruits, vegetables and bakery items.

One aspect of the present invention provides a container for packaging food for transporting and selling to consumers. The container includes a base having a pair of inwardly recessed pockets for capturing a pair of extending latching portions on a lid. The pair of extending latching portions has concave grooves allowing the extending latching portions to flex inwards from an initial position for insertion into the pair of inwardly recessed pockets. When the pair of extending latching portions are inserted into the pair of inwardly recessed pockets, the pair of extending latching portions expand back to their initial position and protrusions within the pair of inwardly recessed pockets retain the pair of extending latching portions creating a tight fit and preventing the lid of the container from being easily disengaged from the base of the container.

Figure 1:
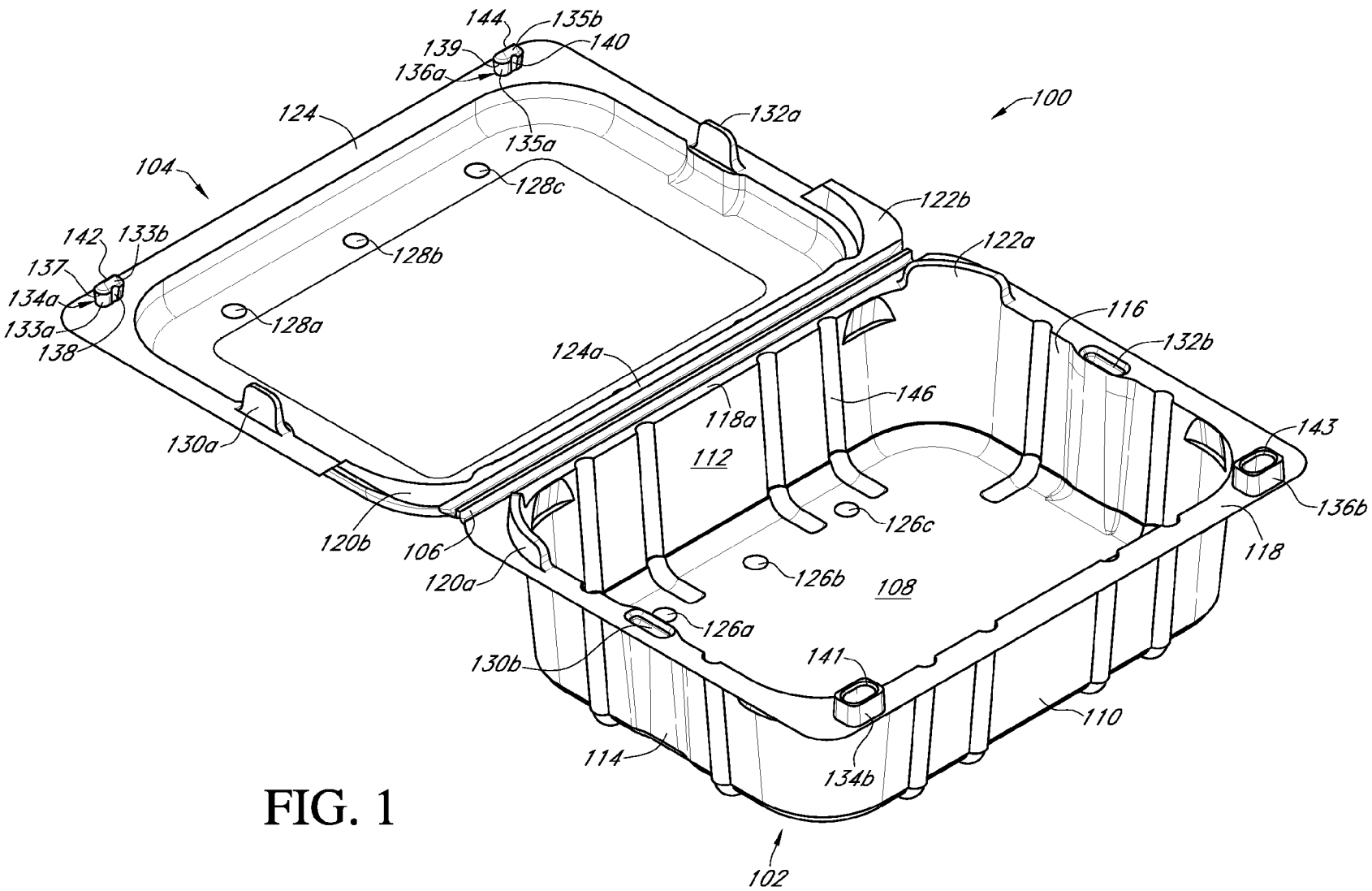
FIG. 1 illustrates a perspective view of a container in an open configuration, according to one aspect of the present invention.
Figure 2:
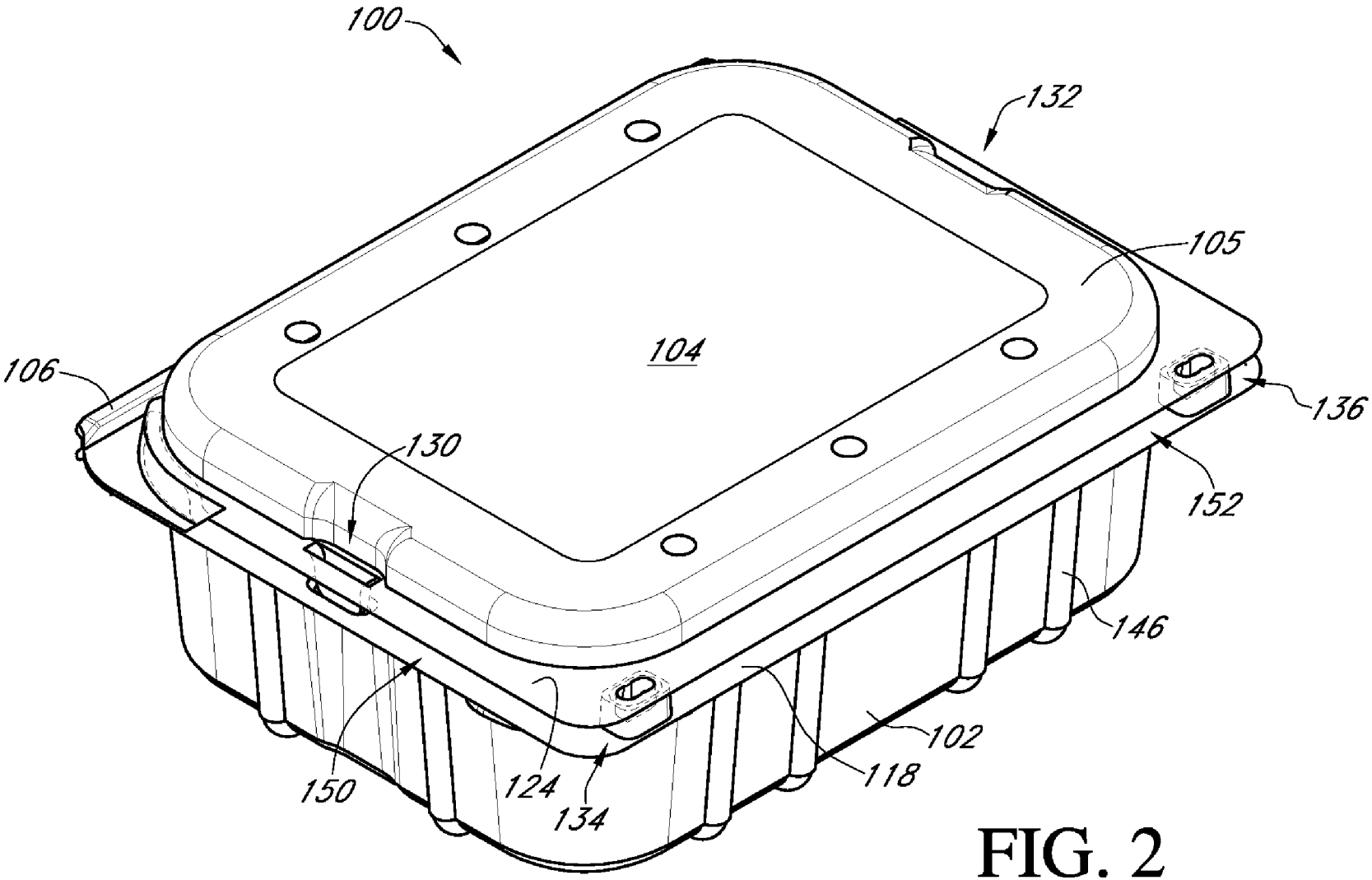
FIG. 2 illustrates a perspective view of a container in a closed configuration, according to one aspect of the present invention.

FIGS. 1 and 2 illustrate perspective views of a container 100 in open and closed configurations, respectively, according to one aspect of the present invention. The container 100 includes a base 102 connected to a lid 104 via a hinge 106. The base 102 includes a bottom 108 and two opposing sidewalls 110 and 112 integrally connected to two opposing end walls 114 and 116. The sidewalls, 110 and 112, and end walls, 114 and 116, extend continuously upwardly from the bottom 108 to form the base 102. A lower flange 118 is integrally connected to, and projecting in an outwardly or generally perpendicular fashion, from the perimeter of the base 102. The lid 104 may include a central raised portion 105 integrally connected to an upper flange 124.

The container 100 may include first and second alignment posts for aligning the lid 104 and the base 102 in a closed configuration. (See FIG. 2) The first and second alignment posts are comprised of lower alignment pins, 120*a* and 122*a*, disposed about a substantially inner portion 118*a* of the lower flange 118, and upper alignment pin locating surfaces, 120*b* and 122*b*, disposed about a substantially inner portion 124*a* of the upper flange 124, and configured to align the lid 104 and base 102 in a closed configuration. In this manner, when the lid 104 is secured to the base 102, the lower alignment pins 120*a* and 122*a* are substantially captured within the upper alignment pin locating surfaces 120*b* and 122*b*, respectively, and maintained in an aligned configuration. Furthermore, the lower alignment pins 120*a* and 122*a* and the upper alignment pin locating surfaces, 120*b* and 122*b* are adjacent to the hinge 106 for substantially precluding lateral movement and potential disengagement of lid 104 from base 102. Alternatively, the lid 104 and base 102 may be hingedly connected according to other methods known in the art.

The container may also include a pair of side bridges to stabilize the lid 104 when the lid is engaged with the base 102. The pair of side bridges may include extending members 130*a* and 132*a*, disposed on the sides of the upper flange 124, and slots 130*b* and 132*b*, disposed in the sides of the lower flange 118 for capturing the extending members 130*a* and 132*a*. In this manner, when lid 104 is secured to the base 102, extending members 130*a* and 132*a* are substantially captured within the slots 130*b* and 132*b* preventing the extending members 130*a* and 132*a* from slipping out if the lid 104 is pushed into the base 102.

The container may also include a pair of locking mechanisms 134 and 136 to secure the lid 104 to the base 102 and prevent consumers from prematurely or easily opening the container 100 prior to sale, as well as preventing the lid 104 from separating from the base 102 during transportation and spilling and/or damaging its contents. The pair of locking mechanisms may include extending latching portions 134*a* and 136*a* which may be received by inwardly recessed pockets 134*b* and 136*b*. When engaged, the extending latching portions 134*a* and 136*a* and inwardly recessed pockets 134*b* and 136*b* snap together, securely holding the lid 104 and base 102 of the container 100 together. Although two locking mechanisms 134 and 136 are shown in FIGS. 1 and 2, the container 100 may have only one locking mechanism or may have more than two locking mechanisms.

In one embodiment, the extending latching portions 134*a* and 136*a* may have lower portions, 133*a* and 135*a* respectively, having an elongated oval shaped configuration having a pair of end sections and a pair of side sections, and upper portions, 133*b* and 135*b* respectively, having rounded ends and downwardly tapering sides that form slightly rounded edges, 142 and 144, respectively, separated by connecting rings 137 and 139. Although the extending latching portions are shown having an elongated oval shaped configuration, this is by way of example only. The extending latching portions 134*a* and 136*a* may be, for example, oval, cone, "chisel" or any other shape to facilitate engagement with the inwardly recessed pockets 134*b* and 136*b*, or any other female portion of the lock.

The edges 142 and 144 allow the extending latching portions 134*a* and 136*a* to guide themselves into the inwardly recessed pockets 134*b* and 136*b* if the lid 104 and the base 102 are not properly aligned when the lid 104 and the base 102 are manually pinched or rolled or pushed together by automated equipment to lock or engage the lid 104 to the base 102, preventing the requirement of having direct alignment. In other words, the edges 142 and 144 allow automatic correction when automatically or manually closing the container.

The extending latching portions 134*a* and 136*a* may further include inner facing notches (or grooves) 138 and 140 and outer facing notches (or grooves, not shown). The grooves allow the side sections of the lower portion of the extending latching portions 134*a* and 136*a* to flex inward (from an initial position) allowing connecting rings 137 and 139 on the extending latching portions 134*a* and 136*a* to slip past protrusions 141 and 143 in the inwardly recessed pockets 134*b* and 136*b*. Once the extending latching portions 134*a* and 136*a* are captured within the inwardly recessed pockets

134*b* and 136*b*, the extending latching portions 134*a* and 136*a* expand (or spring) back to their initial position and the extending latching portions 134*a* and 136*a* are captured by the protrusions 141 and 143 of the inwardly recessed pockets 134*b* and 136*b*, creating a tighter fit and preventing the lid 104 from being easily disengaged from the base 102.

In one embodiment, the base 102 may include a first plurality of ventilations apertures 126*a*, 126*b*, and 126*c* (as well as three additional apertures not shown on the opposite side of the base of the container) and the lid 104 may include a second plurality of ventilation apertures 128*a*, 128*b*, and 128*c* (as well as three additional apertures not shown on the opposite side of the lid of the container) for allowing moisture to escape the container 100 and allow air to flow through. It should be noted that the base 102 and lid 104 may have more than or less than six ventilation apertures or may not include any ventilation apertures at all.

The container 100 may be stiffened by including one or more strengtheners, such as an array of ribs 146, that extend in a generally upwardly direction from the bottom 108 of the base 102 to the lower flange 118, to increase the rigidity of the container 100. The ribs 146 may be formed integrally with the container 100. Each wall 110, 112, 114 and 116 may have at least one rib 146, which at least partially traverses an external surface thereof. The ribs 146 are generally parallel to one another. Alternatively, the container 100 may include a smooth wall design that does not include any strengtheners.

It will be apparent that in closing lid 104 onto base 102, the alignment posts (comprising lower alignment pins, 120*a* and 122*a* and upper alignment pin locating surfaces, 120*b* and 122*b*) disposed about the portions of base 102 and lid 104 immediately adjacent to the hinge 106 will be the first to engage as the lid 104 is closed. As the act of closing the lid 104 continues, the side bridges 130 and 132 are engaged. As described above, applying further closing pressure causes the extending latching portions 134*a* and 136*a* to flex inward allowing them to fit into the inwardly recessed pockets 134*b* and 136*b*.

When the container 100 is in the closed configuration (See FIG. 2) the upper and lower flanges, 118 and 124, define a first ventilation gap 150 along the sidewall 114, a second ventilation gap along the side wall 116 (not shown), and a front ventilation gap 152 across the front of the container 100. Alternatively, the container 100 may include no ventilation gaps, for example if the container 100 were to be used in a bakery application.

The gaps 150 and 152 allow air to pass through the container 100, which may be important if the contents of the container 100 are food. While food, such as fruit, is being packaged and transported, it must remain cold to retain its freshness. The ventilation gaps 150 and 152 allow cool air to flow into the container and, thus, cool its contents. Furthermore, if necessary, the gaps 150 and 152 allow portions of the contents to extend out of the container 100.

In one embodiment, the container 100 is made of Polyethylene Therephthalate (PET).

Figure 3:
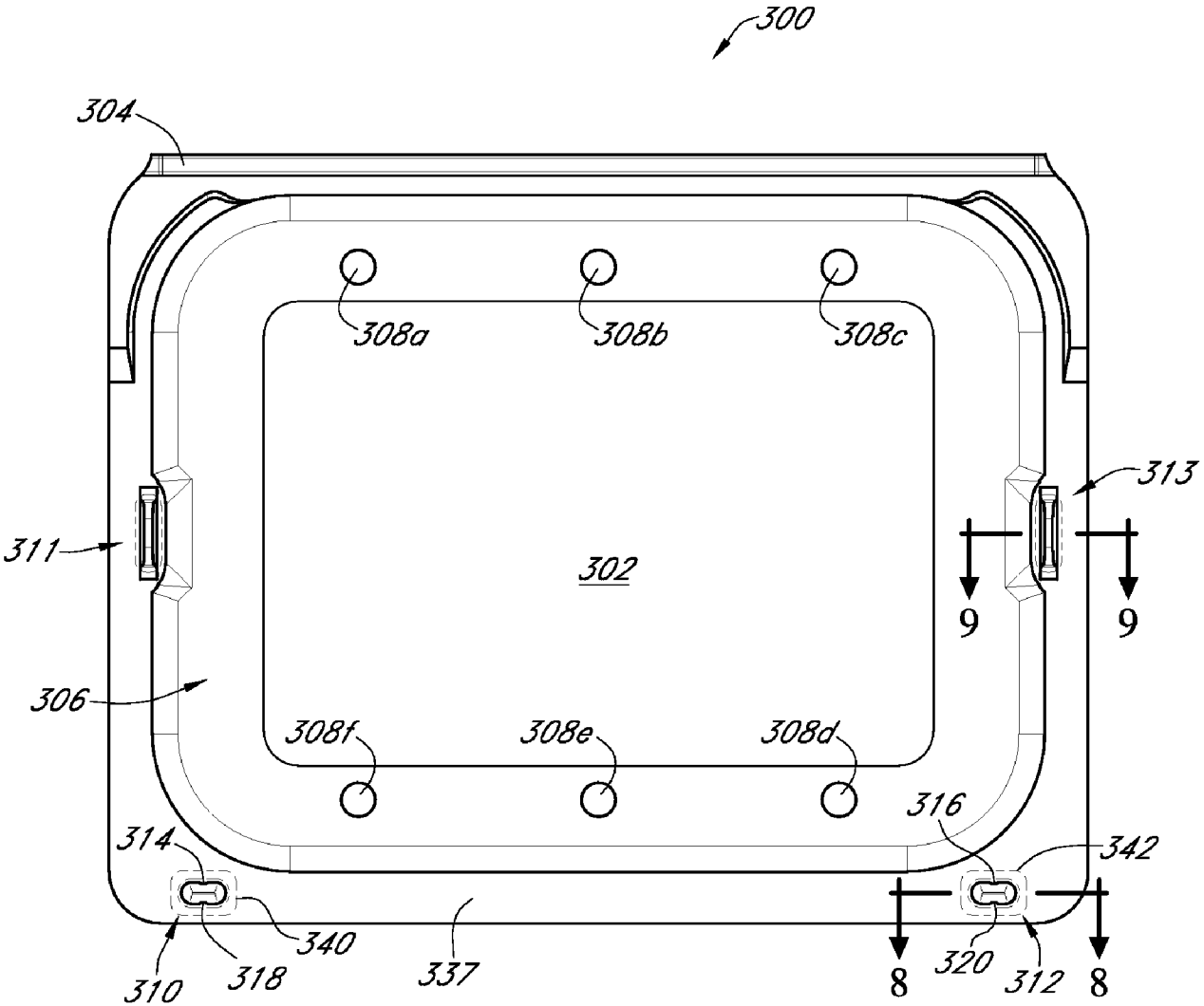
FIG. 3 illustrates a top view of a container in a closed configuration, according to one embodiment of the present invention.

FIG. 3 illustrates a top view of a container 300 in a closed configuration, according to one embodiment of the present invention. The container 300 includes a lid 302 hingedly connected to a base (not shown) via a hinge 304. The lid 302 may have a rectangular configuration with an upwardly extending (or raised) central portion 306 integrally connected to an upper flange 337. A plurality of ventilation apertures 308*a*-308*f* may be located along the outer perimeter of the central portion 306 for allowing air to flow into the container 300 and, thus, cool the contents of the container 300 directly. Alternatively, the ventilation apertures may be side slots that may traverse the base and extend upwardly into the sidewalls.

The ventilation apertures 308*a*-308*f* may be generally circular in shape. However, in alternative embodiments, the apertures may be other shapes, such as ovals, triangles, squares, or other polygons. The ventilation apertures 308*a*-308*f* may be disposed generally symmetrically around the periphery of the central portion 306 of the lid 302. In an alternative embodiment, the apertures 308*a*-308*f* may be alternatively configured. In yet another embodiment, the lid 302 may have more than or less than six ventilation apertures or may not include any ventilation apertures at all.

Also shown in FIG. 3 are top views of first and second locking mechanisms 310 and 312, as well as top views of first and second side bridges 311 and 313. The tops views of the first and second locking mechanisms 310 and 312 show the locking mechanisms 310 and 312 (having a generally elongated oval shape) having inner facing grooves 314 and 316 and outer facing grooves 318 and 320 forming an overall "peanut" or "figure 8" shaped configuration. As described above, the inner facing grooves 314 and 316 and the outer facing grooves 318 and 320 allow extending latching portions of the first and second locking mechanisms 310 and 312 to flex inward as they are inserted into inwardly recessed pockets 340 and 342, respectively. Once the extending latching portions are secured within the inwardly recessed pockets 340 and 342, the extending latching portions expand (or spring) back to their initial position and the extending latching portions are captured by protrusions (described above) of inwardly recessed pockets 340 and 342 creating a tighter fit and preventing the lid 302 from being easily disengaged from the base.

Figure 4:
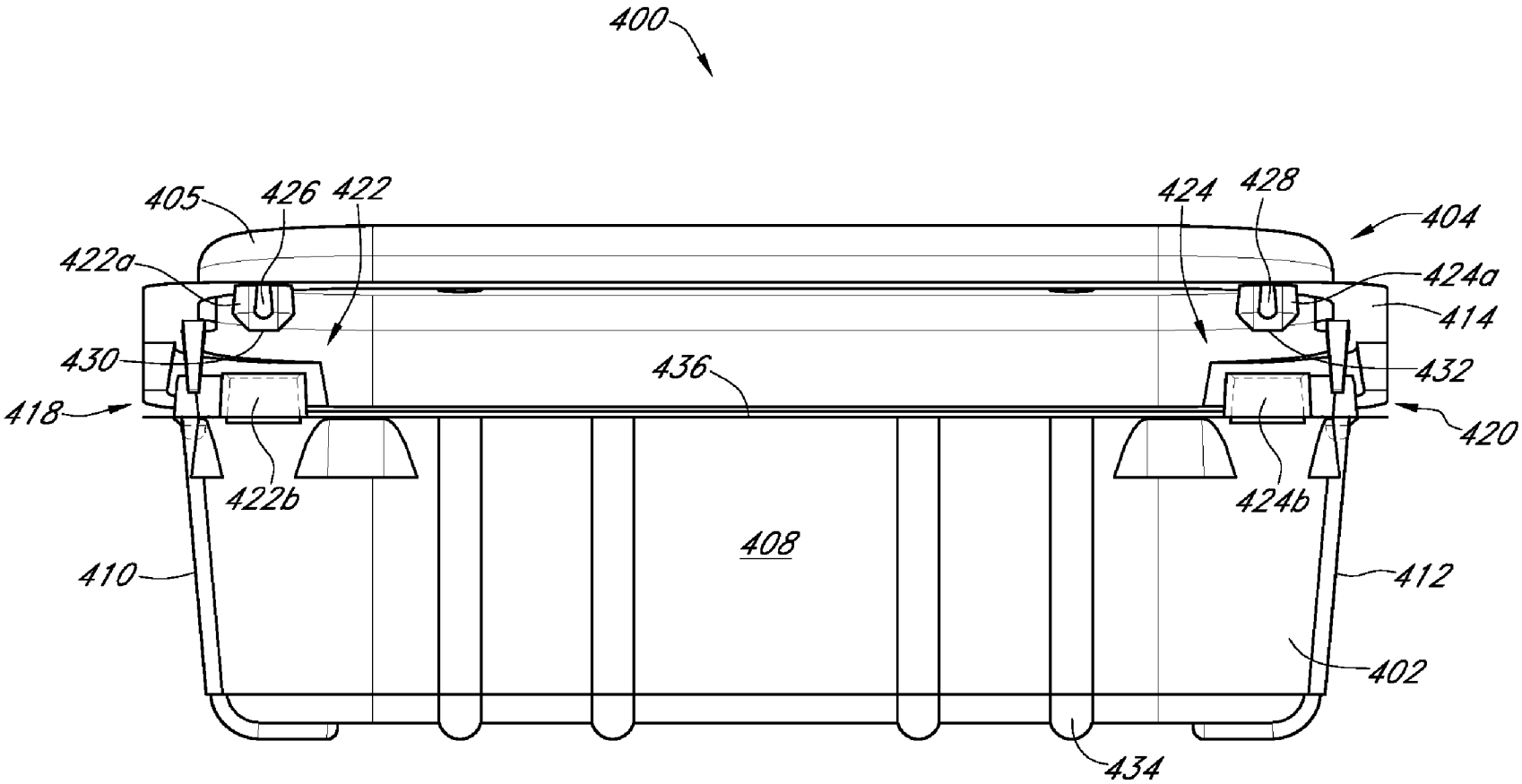
FIG. 4 illustrates a front elevational view of a container, having a lid and base, showing the lid aligned with and in an elevated position displaced from the base.
Figure 5:
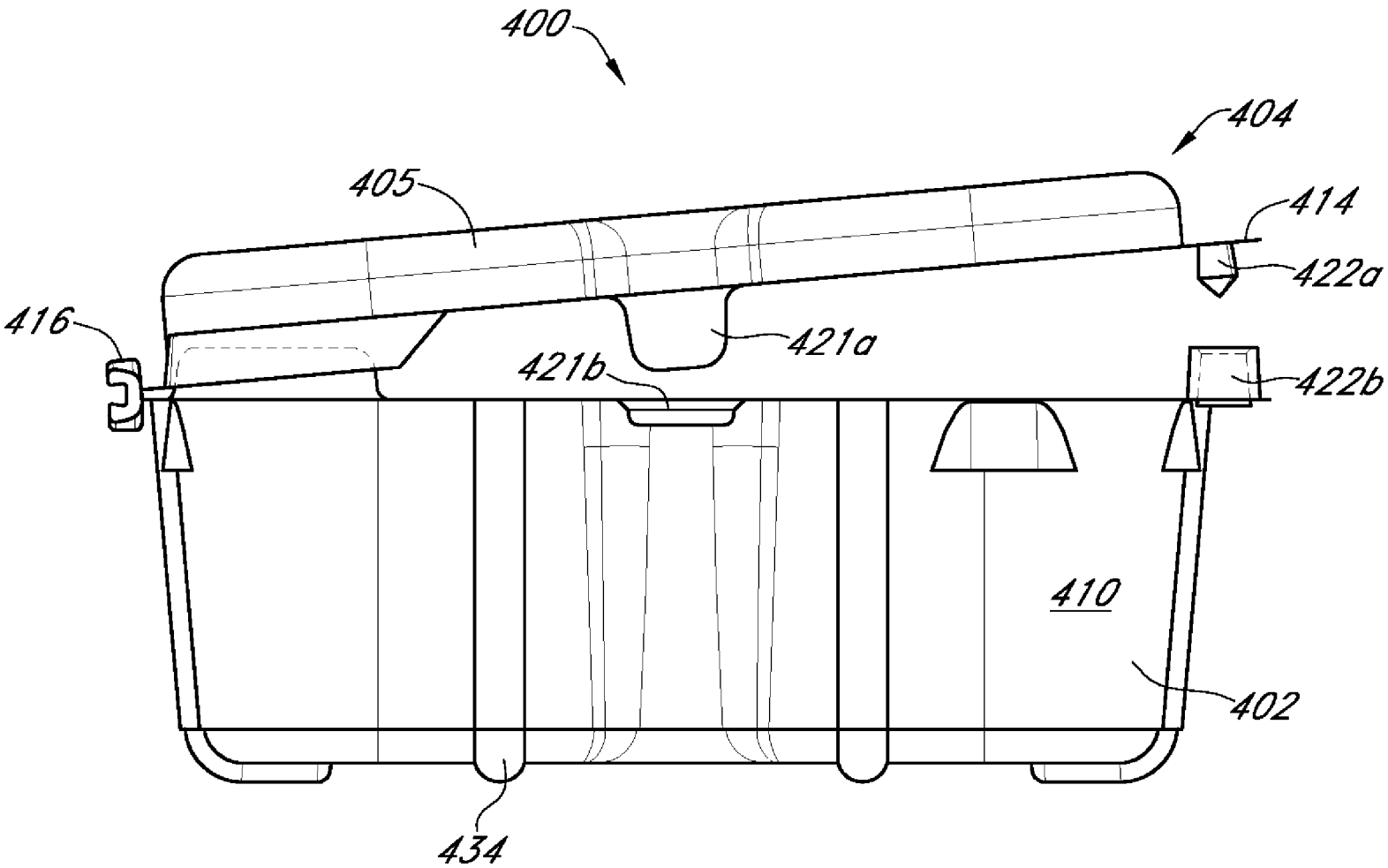
FIG. 5 illustrates a side elevational view of the container of FIG. 4.

FIGS. 4 and 5 illustrate front and side elevational views, respectively, of a container 400, having a base 402 and a lid 404, showing the lid 404 aligned with and in an elevated position displaced from the base 402. The base 402 includes a bottom (not shown) and two opposing sidewalls (only one of which is shown) 408 integrally connected to two opposing end walls 410 and 412. The sidewalls and end walls extend continuously upwardly from the bottom of the base 402. A lower flange 436, which is integrally connected to and projecting outwardly in a generally perpendicular fashion from the two opposing end walls and two opposing sidewalls extending around the perimeter of the base 402. The lid 404 may include a central raised portion 405 integrally connected to an upper flange 414.

The lid 404 is connected to the base 402 via a hinge 416 (as shown in FIG. 5). To secure the lid 404 to the base 402, the container includes a pair of side bridges 418 and 420 and a pair of locking mechanisms 422 and 424. The lid 404 may have a rectangular configuration with an upwardly extending (or raised) central portion 405.

The side bridges 418 and 420 are utilized to stabilize the lid 404 and maintain ventilation gaps (described above) when the lid 404 is engaged with the base 402. FIG. 5 shows a side view of one of the side bridges, on end wall 410, in a disengaged position. The side bridge includes an extending member 421*a*, disposed on the side of the upper flange 414 and a slot 421*b*, disposed in the side of the lower flange 436 for capturing the extending member 421*a*. In this manner, when the lid is secured to the base 402, the extending member 421*a* is substantially captured within the slot 421*b* preventing the extending member 421*a* from slipping out if the lid is pushed into the base 402. The side bridge on the end wall 412 is substantially similar to the side bride on wall 410.

The pair of locking mechanisms may include extending latching portions 422*a* and 424*a* which are received by inwardly recessed pockets 422*b* and 424*b*. As described with reference to FIGS. 1 and 2, when engaged, the extending latching portions 422*a* and 424*a* and the inwardly recessed pockets 422*b* and 424*b* snap together, securely holding the lid 404 and base 402 of the container 400 together, providing rigidity to the container 400 and preventing premature opening of the container, as well as preventing the contents from spilling during transit.

The extending latching portions 422*a* and 424*a* may include inner facing grooves (not shown) and outer facing grooves 426 and 428, one on each side, for causing the extending latching portions 422*a* and 424*a* to flex inward (as described above) allowing the extending latching portions 422*a* and 424*a* to engage the inwardly recessed pockets 422*a* and 424*a*. Once the extending latching portions 422*a* and 424*a* are secured within the inwardly recessed pockets 422*b* and 424*b*, the extending latching portions 422*a* and 424*a* expand (or spring) back to their initial position creating a tighter fit and preventing the lid 404 from being easily disengaged from the base 402.

The extending latching portions 422*a* and 424*a* may include edges 430 and 432, respectively, as described above. The edges 430 and 432 allow the extending latching portions 422*a* and 424*a* to guide themselves into the inwardly recessed pockets 422*a* and 424*a* if the lid 404 and the base 402 are not properly aligned when the lid 404 and the base 402 are pinched, pushed or rolled together to lock or engage the lid 404 to the base 402 preventing the requirement of having direct alignment. In other words, the edges 430 and 432 allow automatic correction when automatically or manually closing the container.

The container 400 may be stiffened further by including one or more strengtheners, such as an array of ribs 434, that extend in a generally upwardly direction from the bottom of the base 402 to the lower flange 436 on the base 402, to increase the rigidity of the container 400. The ribs 434 may be either attached to, or may be formed integrally with, the container 400. Each wall of the container may have at least one rib 434, which at least partially traverses an external surface thereof. The ribs 434 are generally parallel to one another. Alternatively, the container 400 may include a smooth wall design that does not include any strengtheners.

Figure 6:
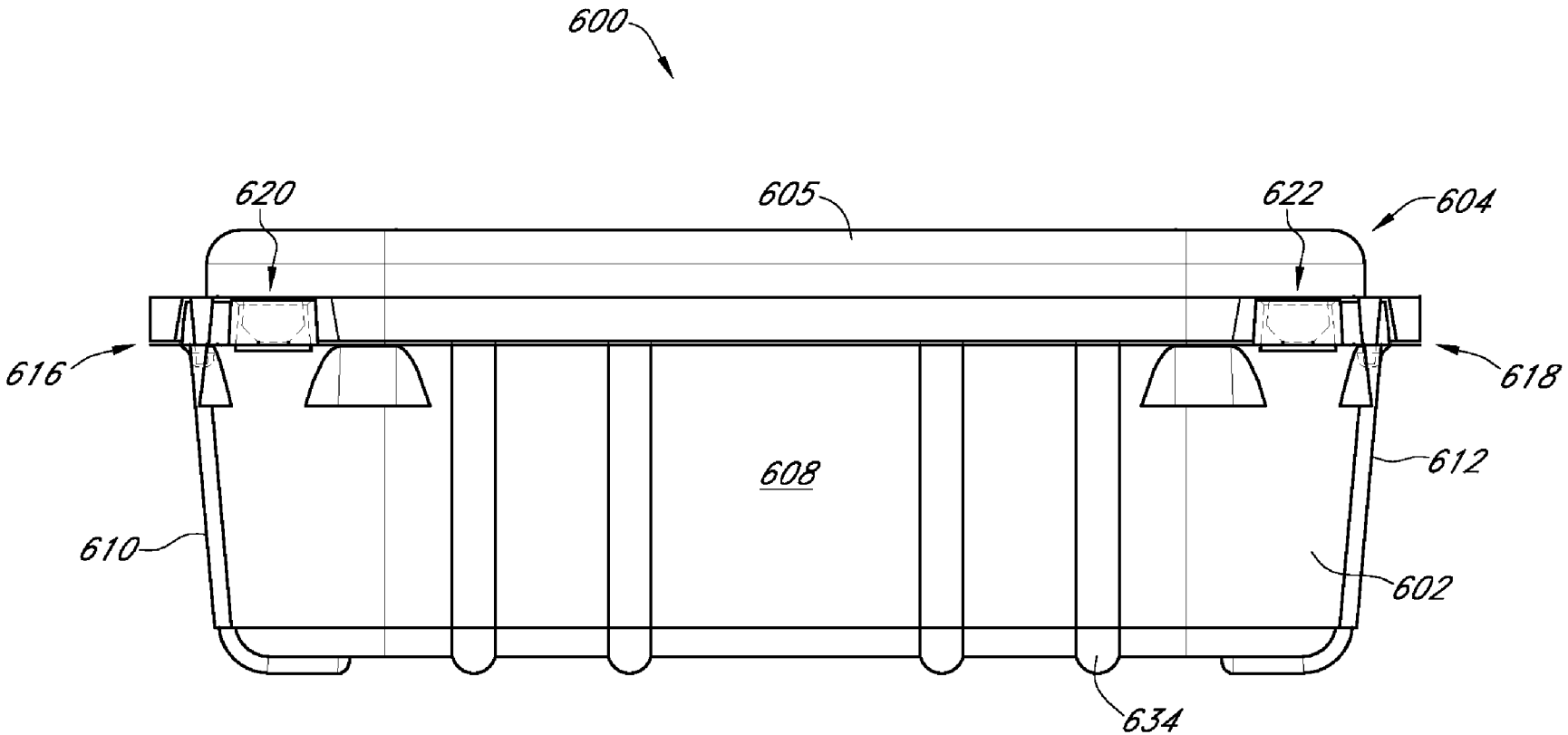
FIG. 6 illustrates a front elevational view of a container in a closed configuration, according to one embodiment of the present invention.
Figure 7:
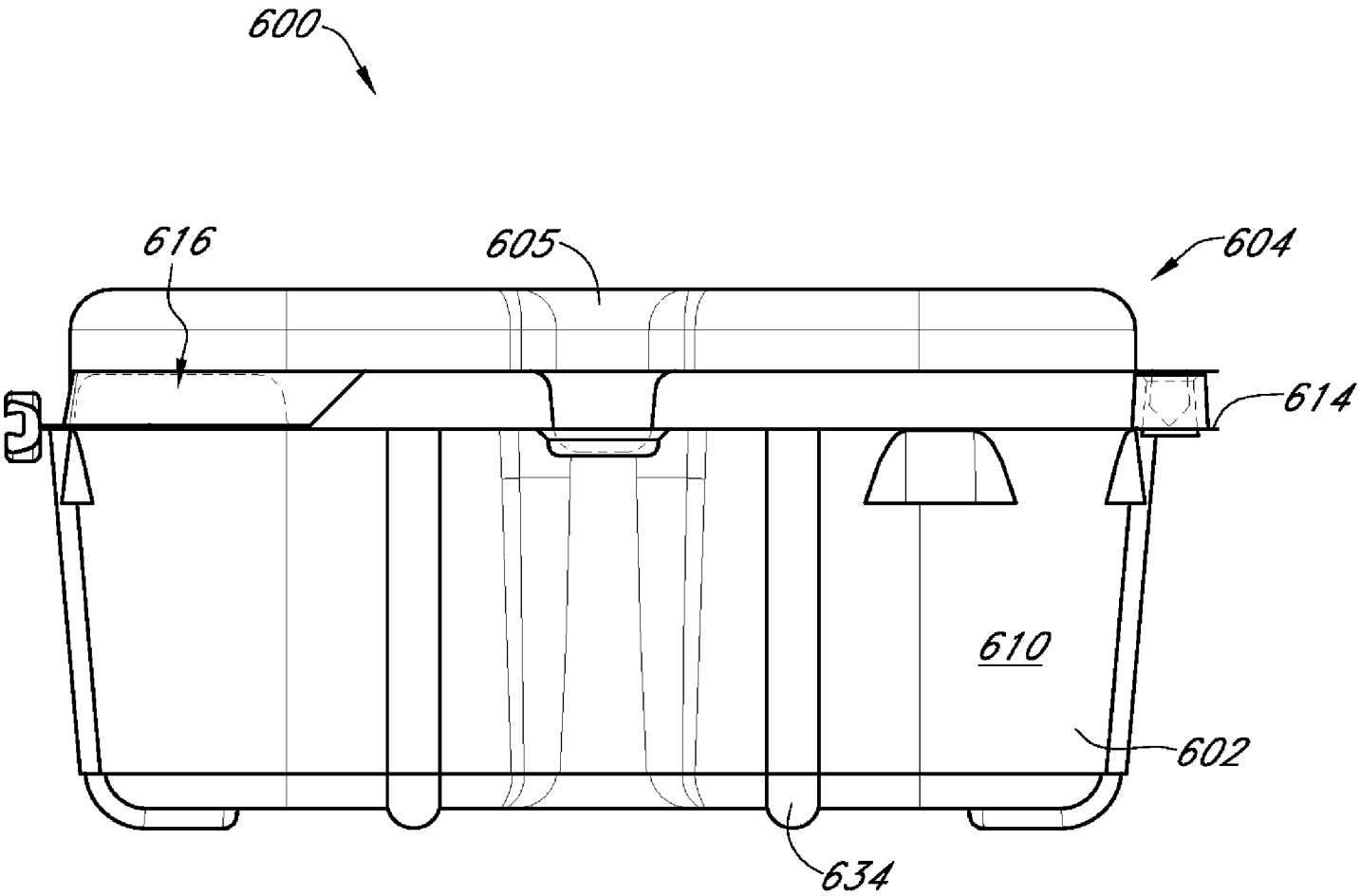
FIG. 7 illustrates a side elevational view of the container of FIG. 6.

FIGS. 6 and 7 illustrate front and side elevational views, respectively, of a container 600 having a base 602 and a lid 604, showing the lid 604 securely engaged with the base 602, according to one embodiment of the present invention. The base 602 includes a bottom (not shown) and two opposing sidewalls (only one of which is shown) 608 integrally connected to two opposing end walls 610 and 612. The sidewalls and end walls extend continuously upwardly from the bottom of the base 602. A lower flange 614 (See FIG. 7), which is integrally connected to and projecting outwardly in a generally perpendicular fashion from the two opposing end walls and two opposing sidewalls extending around the perimeter of the base 602.

The lid 604 is connected to the base 602 via a hinge (See FIG. 7). To retain the lid 604 and base 602 in a closed configuration, the container 600 includes first and second alignment posts 616 and 618 (described above), and first and second locking mechanisms 620 and 622 (described above). The lid 602 may have a rectangular configuration with an upwardly extending (or raised) central portion 605.

The container 600 may be stiffened further by including one or more strengtheners, such as an array of ribs 634, that extend in a generally upwardly direction from the bottom of the base 602 to a lower flange 614 on the base 602, to increase the rigidity of the container 600. The ribs 634 may be either attached to, or may be formed integrally with, the container 600. Each wall of the container may have at least one rib 634, which at least partially traverses an external surface thereof. The ribs 634 are generally parallel to one another. Alternatively, the container 100 may include a smooth wall design that does not include any strengtheners.

Figure 8:
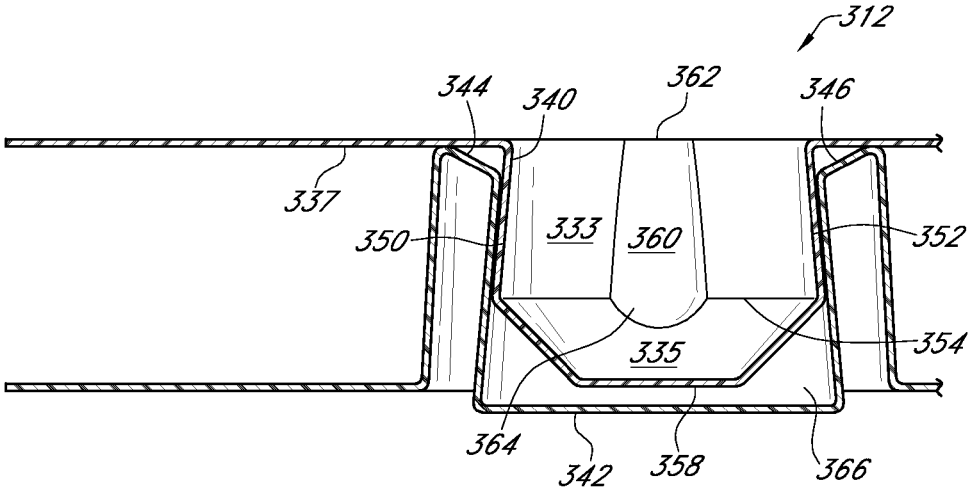
FIG. 8 illustrates a partial cross-sectional view of a locking mechanism taken along line 8-8 of FIG. 3.

FIG. 8 is a partial cross-sectional view of the second locking mechanism 312 taken along line 8-8 of FIG. 3. The locking mechanism 312 includes an extending latching portion 340 which is received by an inwardly recessed pocket 342. When engaged, the extending latching portion 340 and the inwardly recessed pocket 342 snap together, securely holding the lid and base of the container together and providing rigidity to the container. The inwardly recessed pocket 342 includes an inner receiving cavity 366 for receiving the extending latching portion 340.

The extending latching portion 340 may have a lower portion 333 and an upper portion 335, the lower portion 333 integrally formed into the upper flange 337. The lower portion 333 may have an oval shaped configuration having a pair of end sections and a pair of side sections, and the upper portion 335 having rounded ends and downwardly tapering sides that form a slightly rounded edge 358. The lower portion 333 and the upper portion 335 are separated by a connecting ring 354. Although the extending latching portion is described and shown having an elongated oval shaped configuration, this is by way of example only. The extending latching portion 340 may be, for example, oval, cone, "chisel" or any other shape to facilitate engagement with the inwardly recessed pockets 342, or any other female portion of the lock.

An edge 358 allows the extending latching portion 340 to guide itself into the inwardly recessed pocket 342 if the lid and the base are not properly aligned when the lid and the base are pinched, pushed or rolled together to lock or engage the lid to the base preventing the requirement of having direct alignment.

The extending latching portion 340 further includes an inner facing groove 360 and an outer facing groove (not shown). The grooves allow the end sections of the extending latching portion 340 to flex inward allowing the connecting ring 354 on the extending latching portion 340 to slip past protrusions 344 and 346 of the inwardly recessed pocket 342. Once the extending latching portion 340 is captured within the inwardly recessed pocket 342, the extending latching portion 340 expands (or springs) back to its initial position and the extending latching portion 340 is captured by the protrusions 344 and 346 (described above) of the inwardly recessed pocket 342 creating a tighter fit, by providing negative interference, and preventing the lid from being easily disengaged from the base.

The extending latching portion 340 is inserted into the inwardly recessed pocket 342 until the upper flange 337 of the container 300 abuts the top of the connecting ring 344 of the inwardly recessed pocket 342. The sides 350 and 352 of the extending latching portion 340 extend downwardly, flaring outwardly, from the upper flange 337, such that the distance between the two sides increases slightly until reaching the connecting ring 354. From the connecting ring 354, the sides 350 and 352 taper inwards creating the upper portion 335 of the extending latching portion 340.

The concave groove 360 extends from the top 362 of the extending latching portion 340 to slightly below the connecting ring 354. The width of the groove 360 increases as it reaches the connecting ring 354. From the connecting ring 354, the bottom 364 of the groove 360 may form a convex dome.

Figure 9:
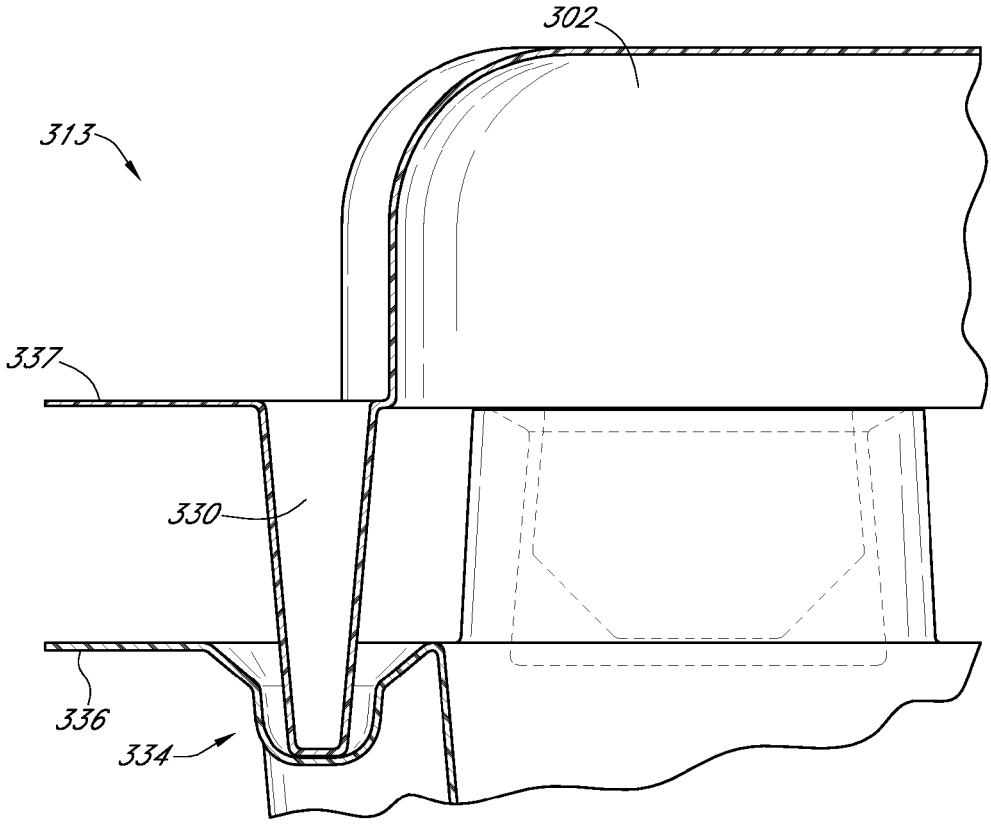
FIG. 9 illustrates a partial cross-sectional view of a side bridge taken along line 9-9 of FIG. 3.

FIG. 9 is a partial cross-sectional view of the second side bridge 313 taken along line 9-9 of FIG. 3. The second side bridge 313 includes an extending member 330 disposed in the middle of the sides of the upper flange 337 of the lid 302 of the container 300 and a slot 334 disposed in the middle of the side of a lower flange 336 of a base of the container 300. In this manner, when the lid 302 is secured to the base, the extending member 330 is substantially captured within the slot 334 creating ventilation gaps (described above) and a load support when the container 300 is in the closed configuration.

Figure 10:
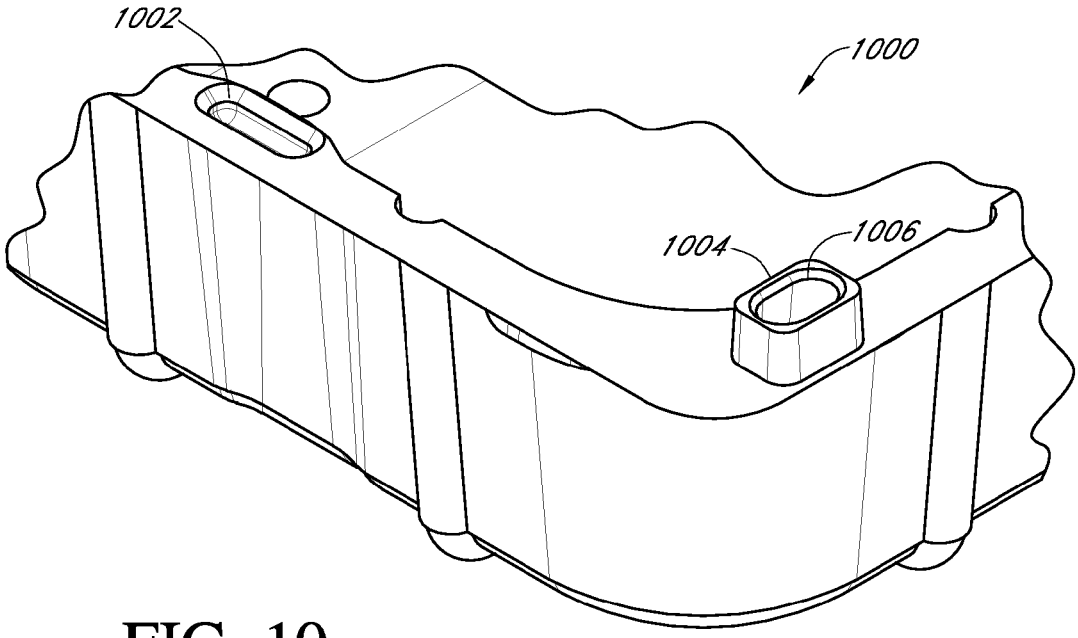
FIG. 10 illustrates a fragmentary view of a base of a container, according to one embodiment of the present invention.

FIG. 10 illustrates a fragmentary view of a base 1000 of a container showing a slot 1002 of a side bridge and an inwardly recessed pocket 1004 of a locking mechanism, according to one embodiment of the present invention. The inwardly recessed pocket 1004 may include a protrusion 1006 for capturing an extending latching portion as described above. Once the extending latching portion is captured within the inwardly recessed pocket 1004, the extending latching portion expands (or springs) back to its initial position and the extending latching portion is captured by the protrusion 1006 of the inwardly recessed pocket 1004 creating a tighter fit, by providing negative interference, and preventing the lid from being easily disengaged from the base.

Figure 11:
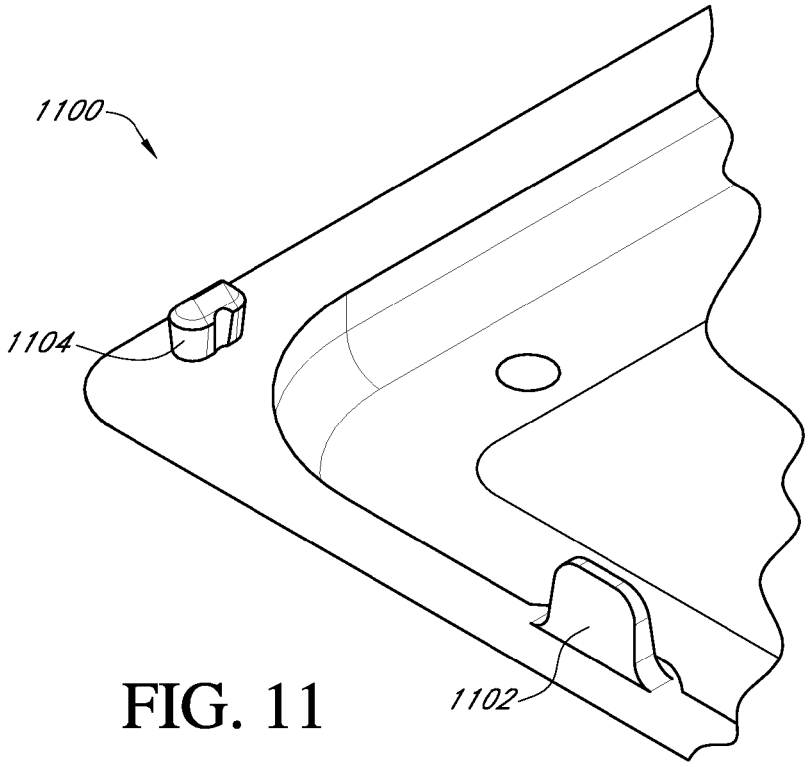
FIG. 11 illustrates a fragmentary view of a lid of a container, according to one embodiment of the present invention.

FIG. 11 illustrates a fragmentary view of a lid 1100 of a container, showing an extending member 1102 of a side bridge and an extending latching portion 1104 of a locking mechanism according to one embodiment of the present invention.

Figure 12:
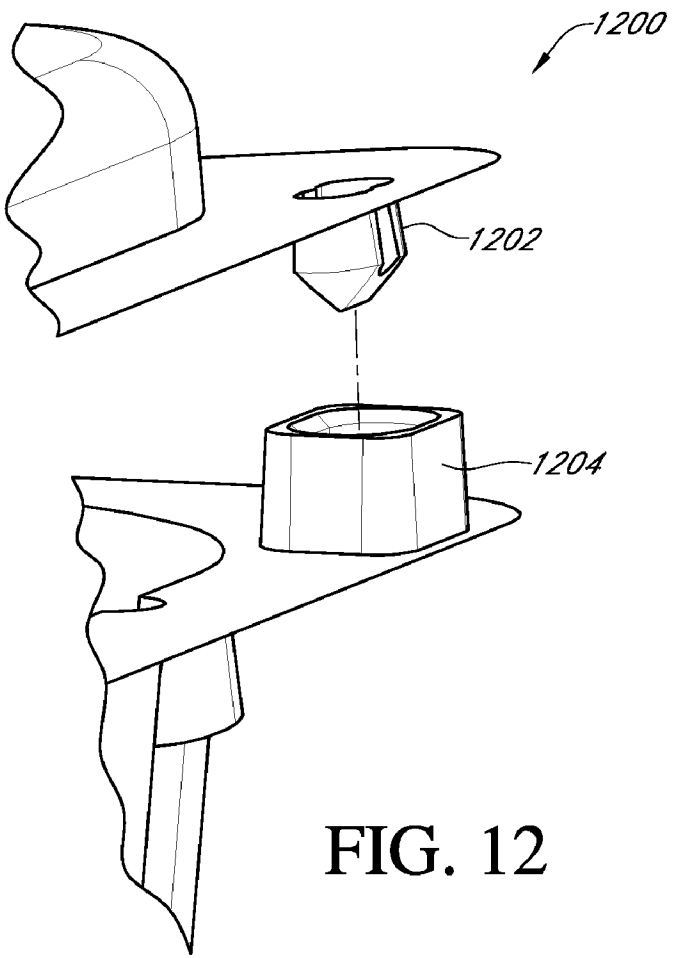
FIG. 12 illustrates a fragmentary view of a container showing a locking mechanism, according to one embodiment of the present invention.

FIG. 12 illustrates a fragmentary view of a container 1200 in a slightly open configuration showing an extending latching portion 1202 of a locking mechanism aligned with an inwardly recessed pocket 1204 of the locking mechanism, according to one embodiment of the present invention.

Figure 13:
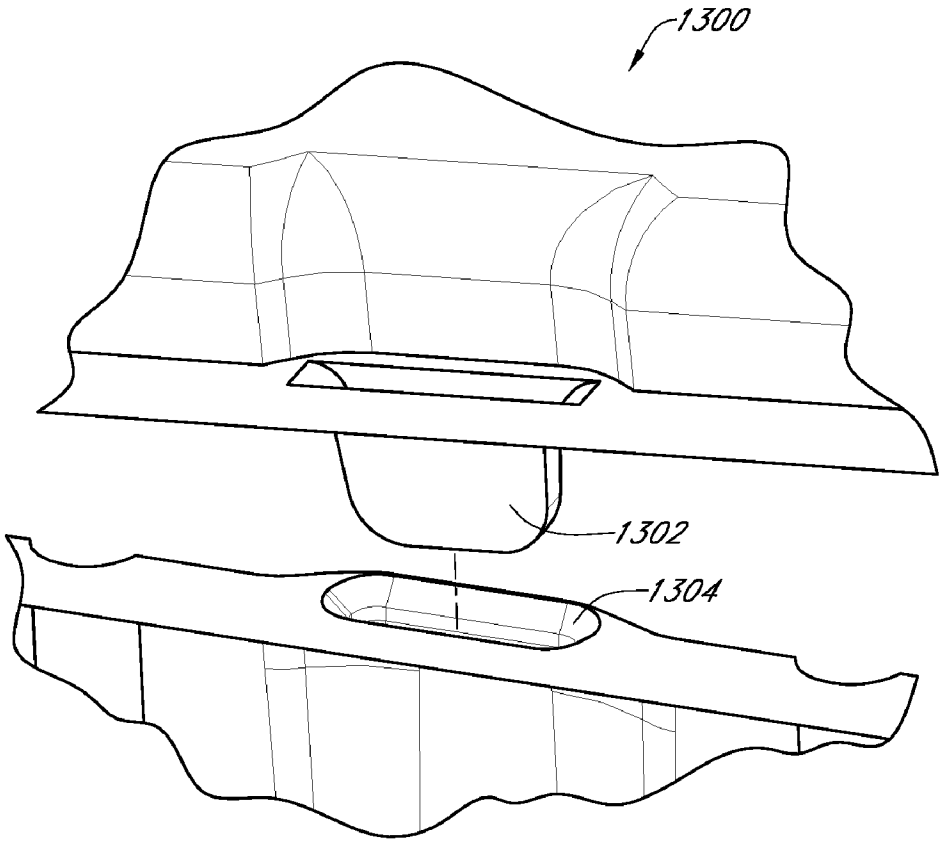
FIG. 13 illustrates a fragmentary view of a container showing a side bridge, according to one embodiment of the present invention.

FIG. 13 illustrates a fragmentary view of a container 1300 in a slightly open configuration showing an extending member 1302 of a side bridge aligned with a slot 1304 of the side bridge, according to one embodiment of the present invention.

Figure 14:
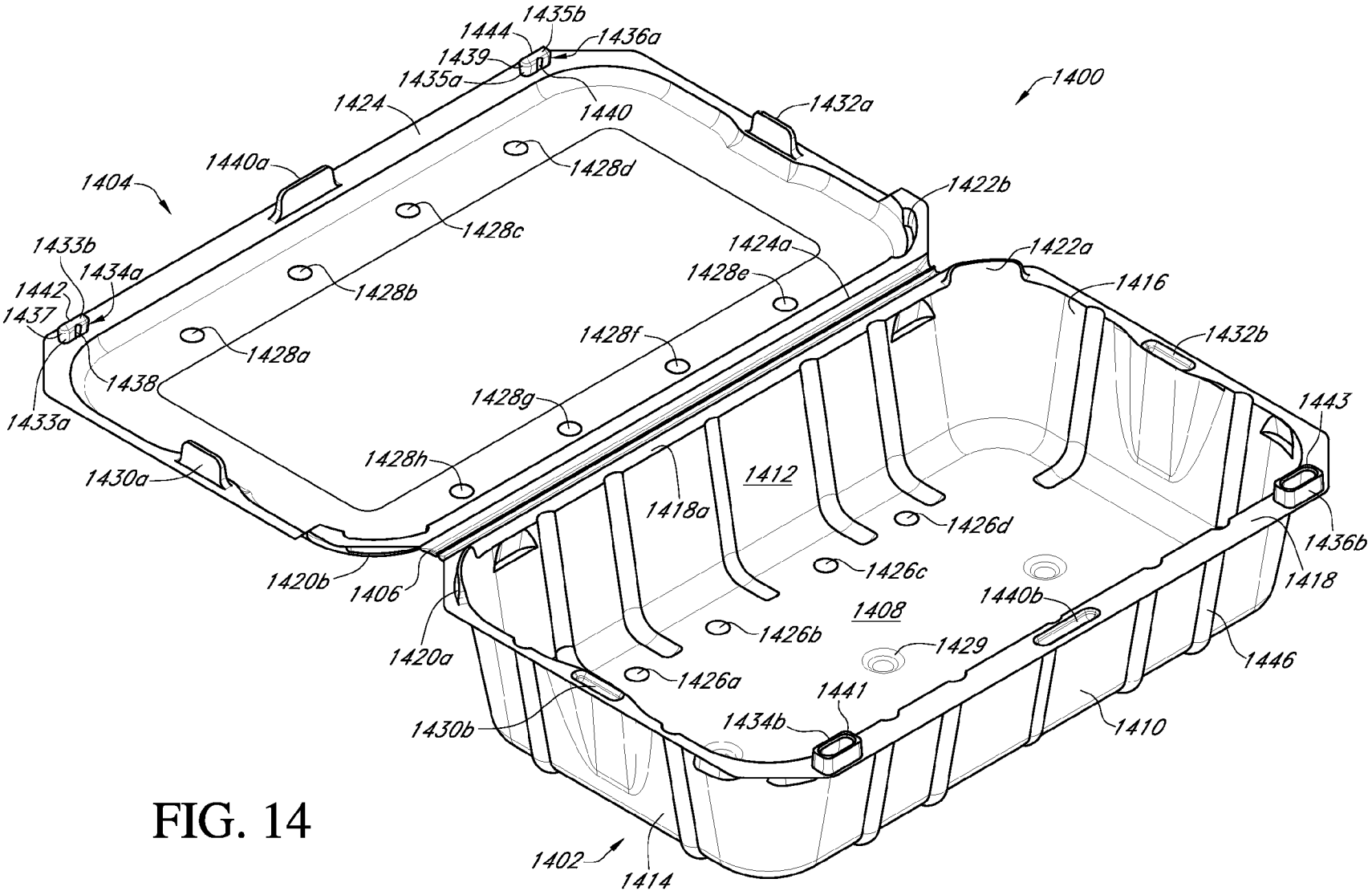
FIG. 14 illustrates a perspective view of a container in an open configuration, according to one aspect of the present invention.
Figure 15:
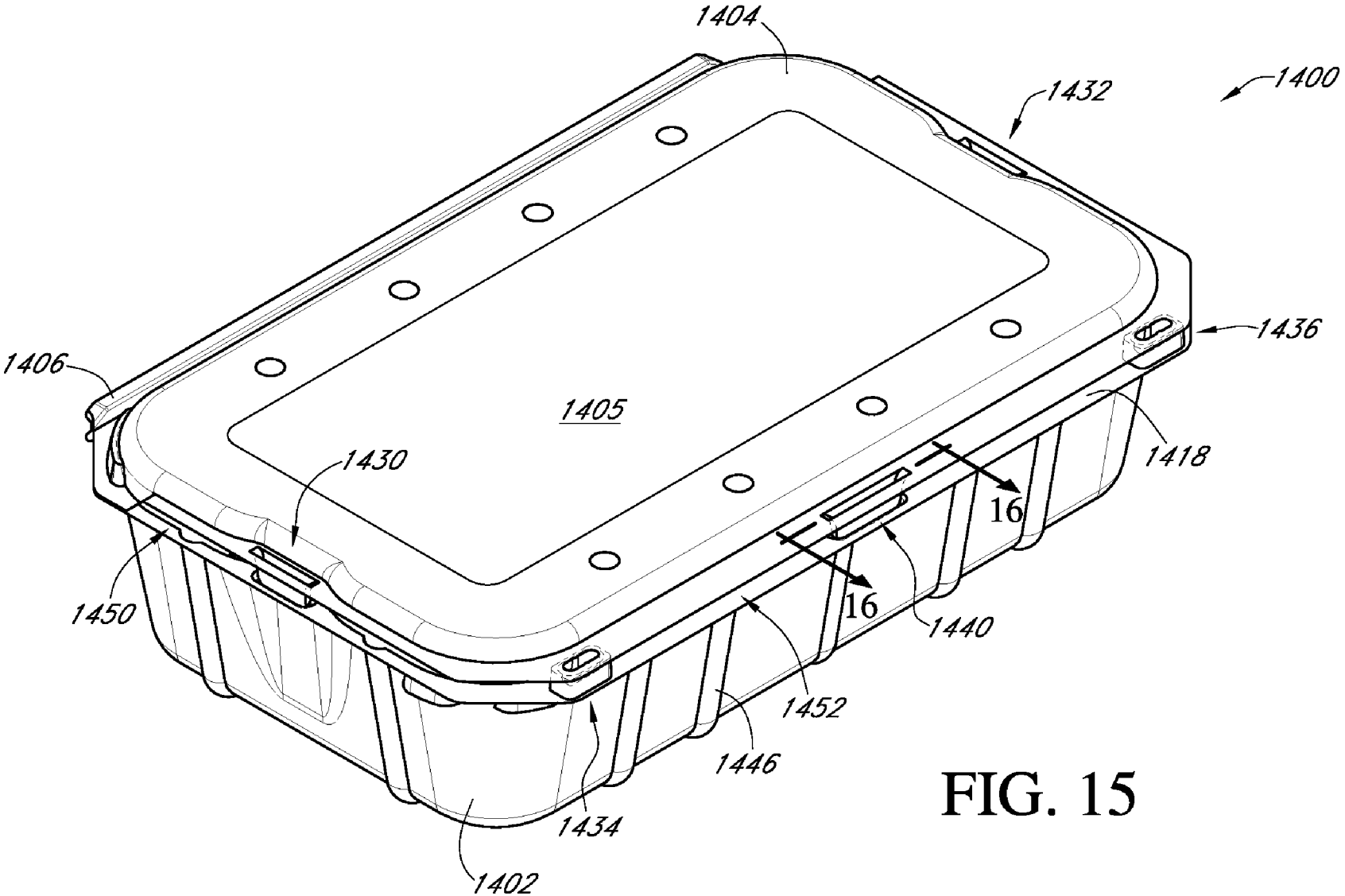
FIG. 15 illustrates a perspective view of a container in a closed configuration, according to one aspect of the present invention.

FIGS. 14-15 illustrate perspective views of a container 1400 in open and closed configurations, respectively, according to one aspect of the present invention. The container 1400 includes a base 1402 connected to a lid 1404 via a hinge 1406. The base 1402 includes a bottom 1408 and two opposing sidewalls 1410 and 1412 integrally connected to two opposing end walls 1414 and 1416. The sidewalls, 1410 and 1412, and end walls, 1414 and 1416, extend continuously upwardly from the bottom 1408 to form the base 1402. A lower flange 1418 is integrally connected to and projecting outwardly in a generally perpendicular fashion, from the perimeter of the base 1402. The lid 1402 includes a central raised portion 1405 (See FIG. 15) integrally connected to an upper flange 1424.

The container 1400 may include first and second alignment posts for aligning the lid 1404 and the base 1402 in a closed configuration. (See FIG. 15) The first and second alignment posts are comprised of lower alignment pins, 1420*a* and 1422*a*, disposed about a substantially inner portion 1418*a* of the lower flange 1418, and upper alignment pin locating surfaces, 1420*b* and 1422*b*, disposed about a substantially inner portion 1424*a* of the upper flange 1424, and configured to align the lid 1404 and base 1402 in a closed configuration. In this manner, when the lid 1404 is secured to the base 1402, the lower alignment pins 1420*a* and 1420*b* are substantially captured within the upper alignment pin locating surfaces 1422*a* and 1422*b*, respectively, and maintained in an aligned configuration. Furthermore, the lower alignment pins 1420*a* and 1420*b* and the upper alignment pin locating surfaces 1422*a* and 1422*b* are adjacent to the hinge 1406 for substantially precluding lateral movement and potential disengagement of lid 1404 from base 1402. Alternatively, the lid 1404 and base 1402 may be hingedly connected according to other methods known in the art.

The container may also include a pair of side bridges to stabilize the lid 1404 when the lid is engaged with the base 1402. The pair of side bridges may include extending members 1430*a* and 1432*a*, disposed on the sides of the upper flange 1424, and slots 1430*b* and 1432*b*, disposed in the sides of the lower flange 1418 for capturing the extending members 1430*a* and 1432*a*. In this manner, when lid 1404 is secured to the base 1402, extending members 1430*a* and 1432*a* are substantially captured within the slots 1430*b* and 1432*b* preventing the extending members 1430*a* and 1432*a* from slipping out if the lid 1404 is pushed into the base 1404.

The container may also include a pair of locking mechanisms 1434 and 1436 (See FIG. 15) to secure the lid 1404 to the base 1402 and prevent consumers from prematurely opening the container 1400 in the store, as well as preventing the lid 1404 from separating from the base 1402 during transportation and spilling and/or damaging its contents. The pair of locking mechanisms may include extending latching portions 1434*a* and 1436*a* which may be received by inwardly recessed pockets 1434*b* and 1436*b*. When engaged, the extending latching portions 1434*a* and 1436*a* and inwardly recessed pockets 1434*b* and 1436*b* snap together, securely holding the lid 1404 and base 1402 of the container 1400 together. Although two locking mechanisms 1434 and 1436 are shown in FIGS. 14 and 15, the container 1400 may have only one locking mechanism or may have more than two locking mechanisms.

In one embodiment, the extending latching portions 1434*a* and 1436*a* may have lower portions, 1433*a* and 1435*a* respectively, having an elongated oval shaped configuration having a pair of end sections and a pair of side sections, and upper portions, 1433*b* and 1435*b* respectively, having rounded ends and downwardly tapering sides that form slightly rounded edges, 1442 and 1444, respectively, separated by connecting rings 1437 and 1439. Although the extending latching portions 1434*a* and 1436*a* are shown having an elongated oval shaped configuration, this is by way of example only. The extending latching portions 1434*a* and 1436*a* may be, for example, oval, cone, "chisel" or any other shape to facilitate engagement with the inwardly recessed pockets 1434*b* and 1436*b*, or any other female portion of the lock.

The edges 1442 and 1444 allow the extending latching portions 1434*a* and 1436*a* to guide themselves into the inwardly recessed pockets 1434*b* and 1436*b* if the lid 1404 and the base 1402 are not properly aligned when the lid 1404 and the base 1402 are pinched or rolled together to lock or engage the lid 1404 to the base 1402 preventing the requirement of having direct alignment. In other words, the edges 1442 and 1444 allow automatic correction when automatically or manually closing the container.

The extending latching portions 1434*a* and 1436*a* may further include inner facing grooves 1438 and 1440 and outer facing grooves (not shown). The grooves allow the extending latching portions 1434*a* and 1436*a* to flex inward allowing the connecting rings 1437 and 1439 on the extending latching portions 1434*a* and 1436*a* to slip past protrusions 1441 and 1443 in the inwardly recessed pockets 1434*b* and 1436*b*. Once the extending latching portions 1434*a* and 1436*a* are captured within the inwardly recessed pockets 1434*b* and 1436*b*, the extending latching portions 1434*a* and 1436*a* expand (or spring) back to their initial position and the extending latching portions 1434*a* and 1436*a* are captured by the protrusions 1441 and 1443 of the inwardly recessed pockets 1434*b* and 1436*b*, creating a tighter fit and preventing the lid 1404 from being easily disengaged from the base 1402.

In one embodiment, the lid 1404 may include a first plurality of ventilations apertures 1428*a*-1428*h* and the base 1402 may include a second plurality of ventilation apertures 1428*a*, 1428*b*, 1428*c* and 1428*d* (as well as four additional apertures not shown on the opposite side of the base of the container) for allowing moisture to escape the container 1400 and allow air to flow through. It should be noted that the base 1402 and lid 1404 may have more than or less than six ventilation apertures or may not include any ventilation apertures at all. In one embodiment, the base 1402 may include a plurality of holes 1429 for allowing water to drain from the container.

The container 1400 may be stiffened further by including one or more strengtheners, such as an array of ribs 1446, that extend in a generally upwardly direction from the bottom 1408 of the base 1402 to the lower flange 1418, to increase the rigidity of the container 1400. The ribs 1446 may be either attached to, or may be formed integrally with, the container 1400. Each wall 1410, 1412, 1414 and 1416 may have at least one rib 1446, which at least partially traverses an external surface thereof. The ribs 1446 are generally parallel to one another. Alternatively, the container 1400 may include a smooth wall design that does not include any strengtheners.

It will be apparent that in closing lid 1404 onto base 1402, the alignment posts disposed about the portions of base 1402 and lid 1404 immediately adjacent to the hinge 1406 will be the first to engage as the lid 1404 is closed. As the act of closing the lid 1404 continues, the side bridges 1430 and 1432 are engaged. As described above, applying further closing pressure causes the end sections of the extending latching portions 1434*a* and 1436*a* to flex inward allowing them to fit into the inwardly recessed pockets 1434*b* and 1436*b*.

When the container 1400 is in the closed configuration (See FIG. 15) the upper and lower flanges, 1418 and 1424, define a first ventilation gap 1450 along the end wall 1414, a second ventilation gap along the end wall 1416 (not shown), and a front ventilation gap 1452 across the front of the container 1400. The gaps 1450 and 1452 allow air to pass through the container 1400, which is important if the contents of the container 1400 are food. While food, such as fruit, is being transported, it must remain cold to retain its freshness. The ventilation gaps 1450 and 1452 allow cool air to flow into the container and, thus, cool its contents. Furthermore, if necessary, the gaps 1450 and 1452 allow portions of the contents of the contents to extend out of the container 1400. For instance, if the container 1400 contains cherries, the gaps 1450 and 1452 allow the stems of the cherries to extend out the sides of the container 1400.

To stabilize the lid 1404 (lengthwise) and prevent the lid 1404 from encroaching into the base 1402 in large container, a front support bridge 1440 may be utilized. The front support bridge 1440 has a front extending member 1440*a* disposed on the front of the upper flange 1424 and a front slot 1440*b* disposed on the front of the lower flange 1418 for capturing the front extending member 1440*a*. In this manner, when the lid 1404 is secured to the base 1402, the front extending member 1440*a* is substantially captured within the front slot 1440*b* creating a front ventilation slot 1442 (described above) when the container 1400 is in the closed configuration (See FIG. 15).

In one embodiment, the container 1400 is made of Polyethylene Therephthalate (PET), Polystyrenes, Polypropylenes, Crystallized PET or any other material known in the art.

Figure 16:
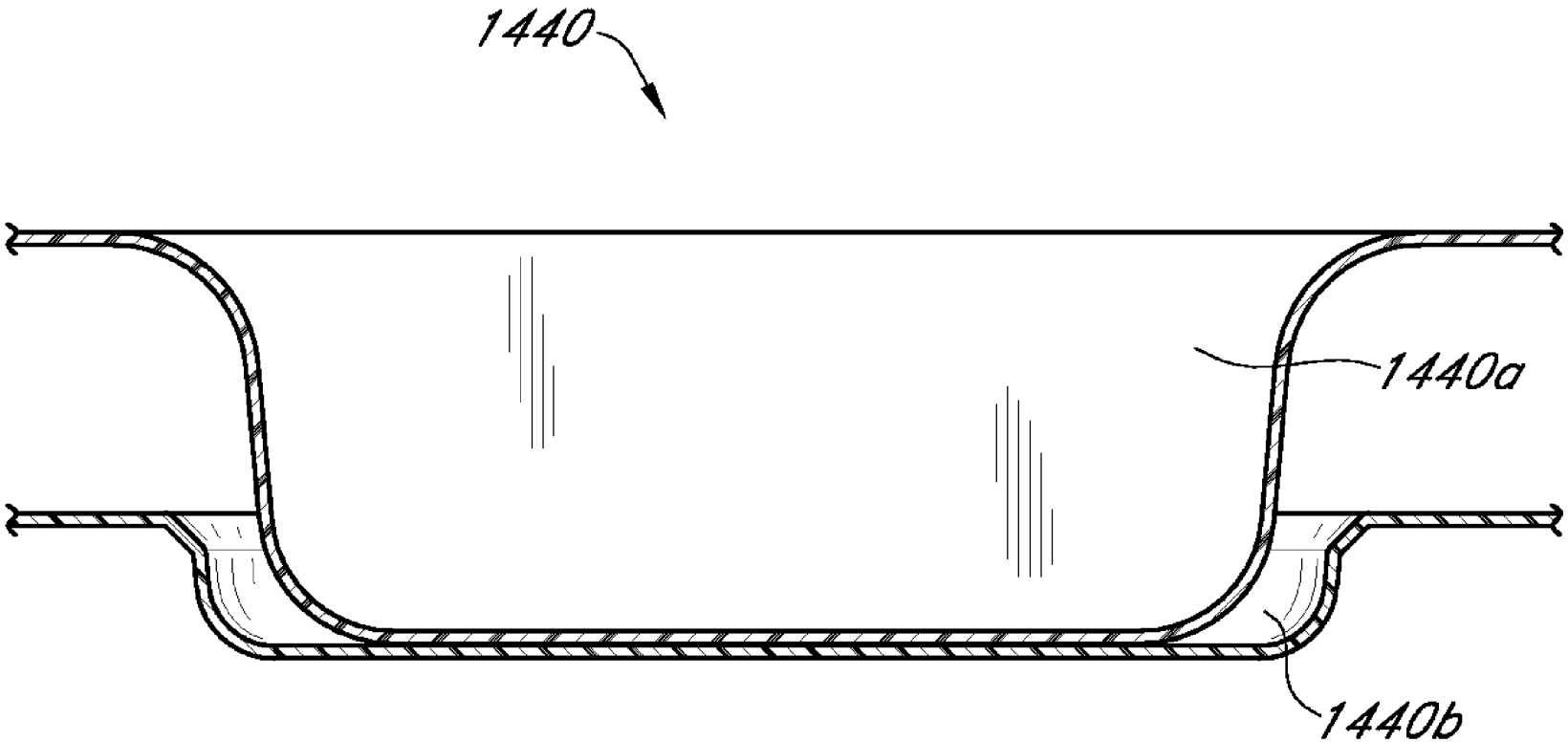
FIG. 16 illustrates a partial cross-sectional view of a front bridge taken along line 16-16 of FIG. 15.

FIG. 16 illustrates a partial cross-sectional view of the front bridge 1440 taken along line 16-16 of FIG. 15. The front bridge 1440 includes the front extending member 1440*a* and the slot 1440*b*.

Figure 17:
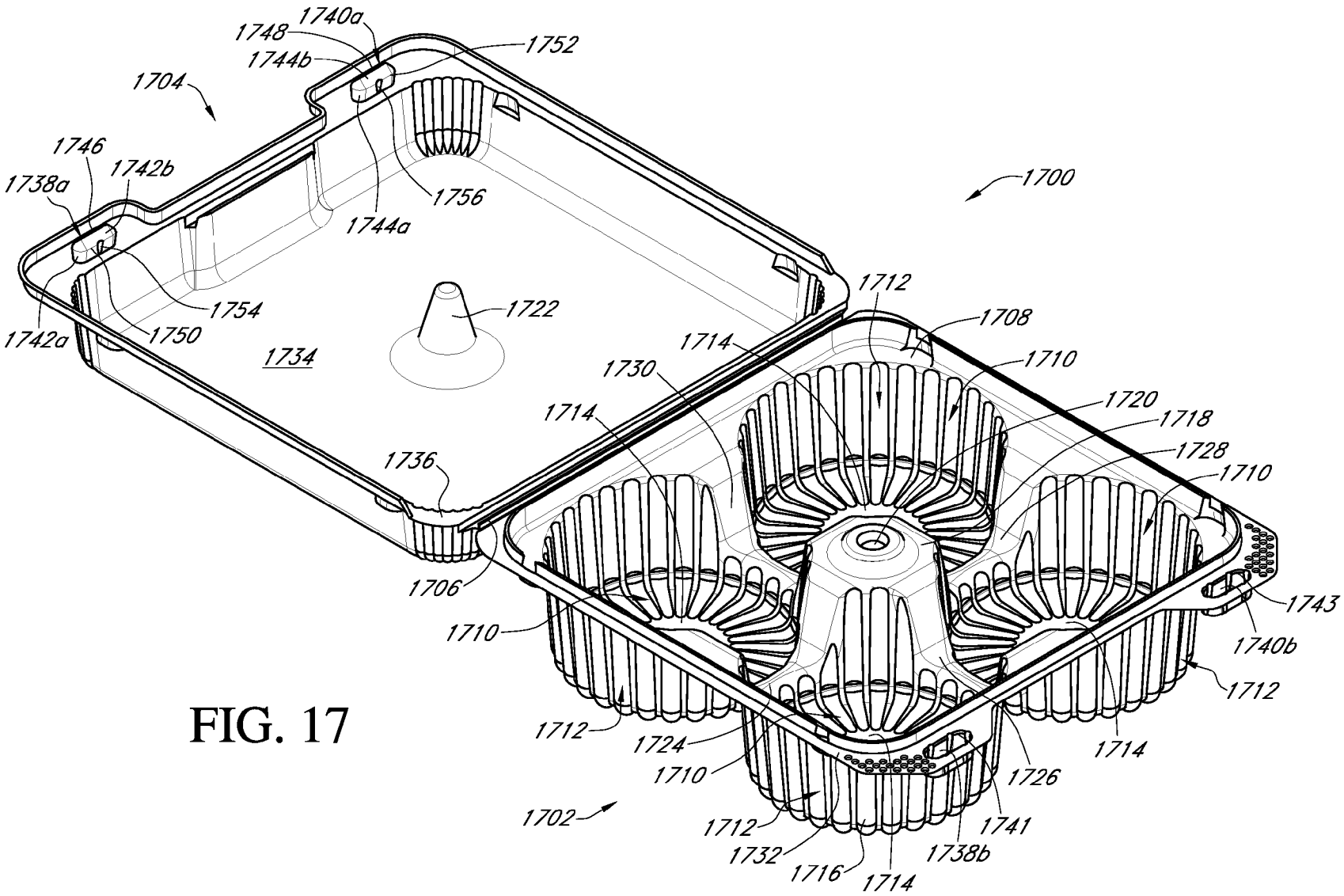
FIG. 17 illustrates a perspective view of a container in an open configuration, according to another aspect of the present invention.
Figure 18:
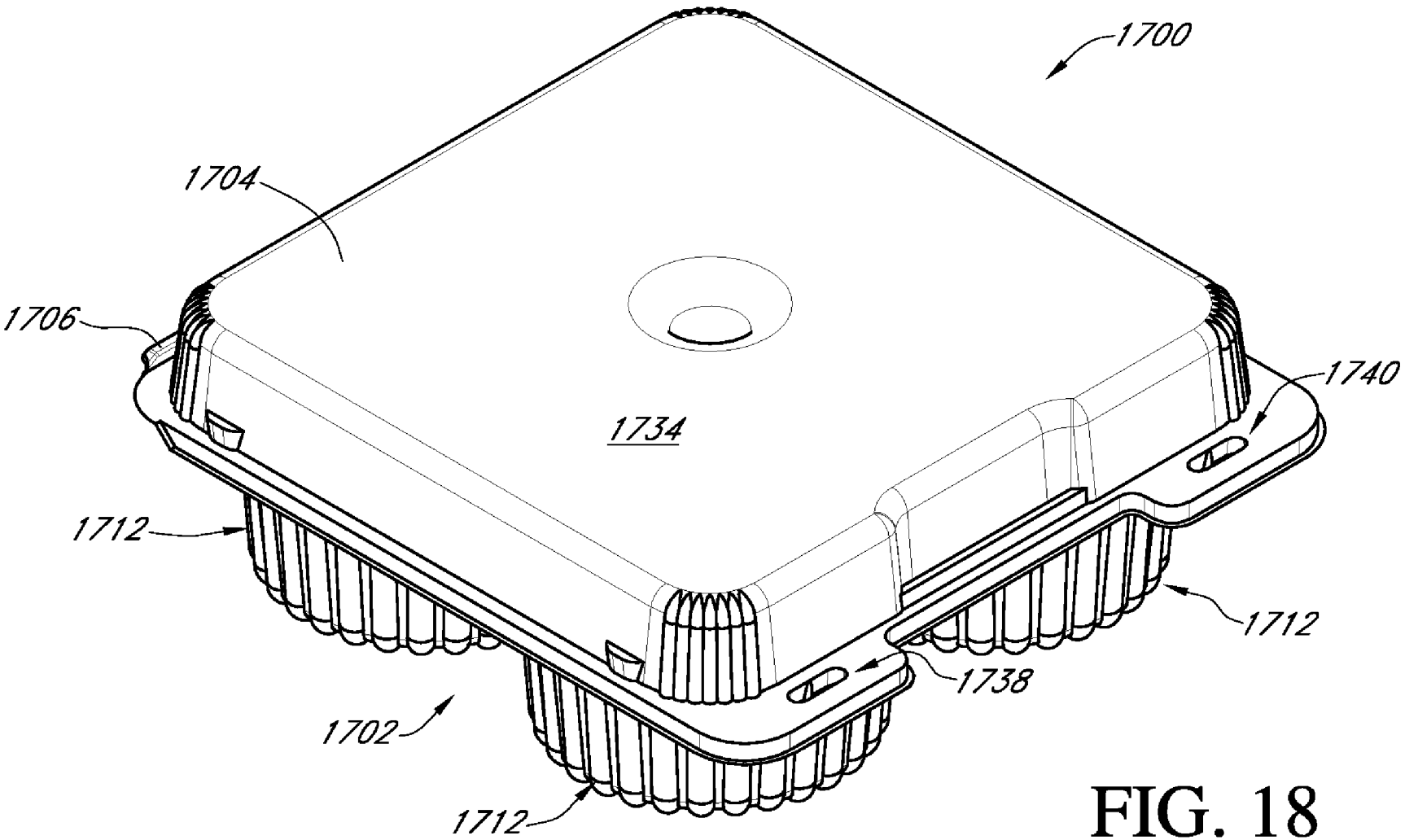
FIG. 18 illustrates a perspective view of the container of FIG. 17 in a closed configuration.

FIGS. 17 and 18 illustrate perspective views of a container 1700 in open and closed configurations, respectively, according to one aspect of the present invention. The container 1700 includes a base 1702 connected to a lid 1704 via a hinge 1706. The base 1702 has a generally planar top portion 1708 from which a plurality of wells 1710 protrude downwardly. Each well 1710 includes a circular side wall 1712 extending downwardly and blends into a closed end that is generally a circular bottom portion 1714, which may have a flat or patterned surface, which closes the bottom of the well 1710. The patterned surface pattern may be a series of raised striations.

The side wall 1712 of each well 1710 may be stiffened by one or more strengtheners, such as an array of ribs 1716, that extend in a generally downwardly direction from the generally planar top portion 1708 of the base 1702 to the bottom portion 1714 of each well 1710 to increase the rigidity of each well 1710. The ribs 1716 may be formed integrally with the container 1700. Each side wall 1712 may have at least one rib 1716, which at least partially traverses an external surface thereof. Alternatively, the container 1700 may include a smooth wall design that does not include any strengtheners.

In one embodiment, a center divider 1718 may extend continuously upwardly from the bottom portions 1714 of the plurality of wells 1710 to separate each of the wells and also form portions of the sidewalls to the wells. The divider 1718 may include a pin hole 1720 for receipt of a radially projecting protrusion 1722 located on the lid 1704. When container 1700 is in the closed position, the radially projecting protrusion 1722 may be inserted into the pin hole 1720 to stabilize the lid 1704 when the lid 1704 is engaged with the base 1702.

The base 1702 may further include a plurality of dividers 1724-1730 that may extend continuously upwardly from the bottom portions 1714 of the plurality of wells 1710 to further separate each of the wells and also form portions of the sidewalls to the wells.

A lower flange 1732 may be integrally connected to, and projecting in an outwardly or generally perpendicular fashion, from the perimeter of the base 1702. The lid 1702 may include a central raised portion 1734 integrally connected to an upper flange 1736.

The container may also include a pair of locking mechanisms 1738 and 1740 (See FIG. 18) to secure the lid 1704 to the base 1702 and prevent consumers from prematurely or easily opening the container 1700 prior to sale, as well as preventing the lid 1704 from separating from the base 1702 during transportation and spilling and/or damaging its contents. The pair of locking mechanisms 1738 and 1740 may include extending latching portions 1738*a* and 1740*a* which may be received by inwardly recessed pockets 1738*b* and 1740*b*. When engaged, the extending latching portions 1738*a* and 1740*a* and inwardly recessed pockets 1738*b* and 1740*b* snap together, securely holding the lid 1704 and base 1702 of the container 1700 together. Although two locking mechanisms 1738 and 1740 are shown in FIGS. 17 and 18, the container 1700 may have only one locking mechanism or may have more than two locking mechanisms.

In one embodiment, the extending latching portions 1738*a* and 1740*a* may have lower portions, 1742*a* and 1744*a* respectively, having an elongated oval shaped configuration having a pair of end sections and a pair of side sections, and upper portions, 1742*b* and 1744*b* respectively, having rounded ends and downwardly tapering sides that form slightly rounded edges, 1746 and 1748, respectively, separated by connecting rings 1750 and 1752. Although the extending latching portions 1738*a* and 1740*a* are shown having an elongated oval shaped configuration, this is by way of example only. The extending latching 1738*a* and 1740*a* may be, for example, oval, cone, "chisel" or any other shape to facilitate engagement with the inwardly recessed pockets 1738*b* and 1740*b*, or any other female portion of the lock.

The edges 1746 and 1748 allow the extending latching portions 1738*a* and 1740*a* to guide themselves into the inwardly recessed pockets 1738*b* and 1740*b* if the lid 1704 and the base 1702 are not properly aligned when the lid 1704 and the base 1702 are manually pinched or rolled or pushed together by automated equipment to lock or engage the lid 1704 to the base 1702 preventing the requirement of having direct alignment. In other words, the edges 1746 and 1748 allow automatic correction when automatically or manually closing the container.

The extending latching portions 1738*a* and 1740*a* may further include inner facing notches (or grooves) 1754 and 1756 and outer facing notches (or grooves, not shown). The grooves allow the side sections of the lower portion of the extending latching portions 1738*a* and 1740*a* to flex inward (from an initial position) allowing the connecting rings 1750 and 1752 on the extending latching portions 1738*a* and 1740*a* to slip past protrusions 1741 and 1743 in an upper innermost circumference the inwardly recessed pockets 1738*b* and 1740*b*. Once the extending latching portions 1738*a* and 1740*a* are captured within the inwardly recessed pockets 1738*b* and 1740*b*, the extending latching portions 1738*a* and 1740*a* expand (or spring) back to their initial position and the extending latching portions 1738*a* and 1740*a* are captured by the protrusions 1741 and 1743 of the inwardly recessed pockets 1738*b* and 1740*b*, creating a tighter fit and preventing the lid 1704 from being easily disengaged from the base 1702.

Figure 19:
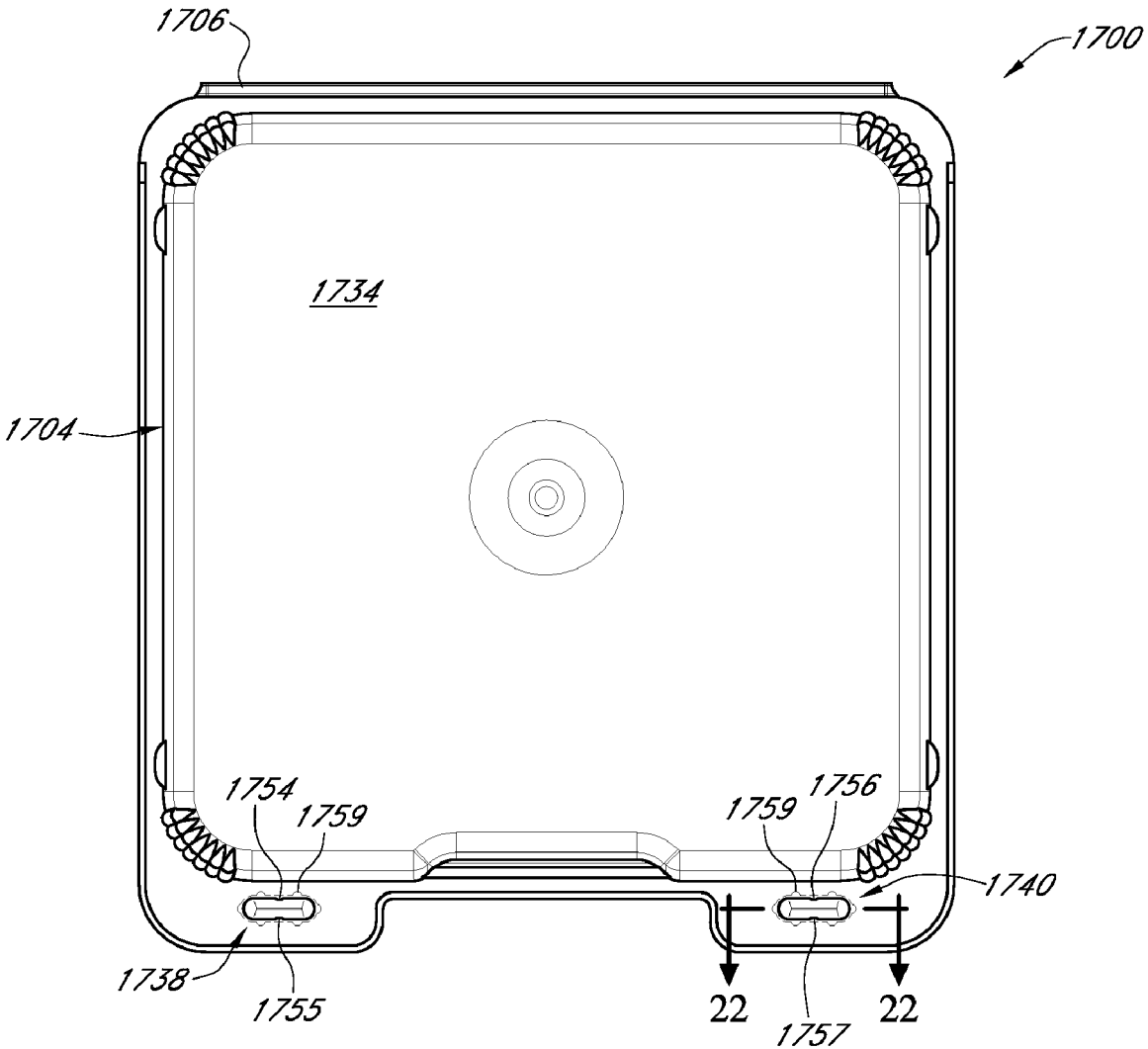
FIG. 19 illustrates a top view of a container of the container of FIG. 17 in a closed configuration.

FIG. 19 illustrates a top view of the container 1700 of FIG. 17 in a closed configuration. Top views of the first and second locking mechanisms 1738 and 1740 show the locking mechanisms 1738 and 1740 (having a generally elongated oval shape) having inner facing grooves 1754 and 1756 and outer facing grooves 1755 and 1757 forming an overall "peanut" or "figure 8" shaped configuration. As described above, the inner facing grooves 1754 and 1756 and the outer facing grooves 1755 and 1757 allow extending latching portions 1738*a* and 1740*a* of the first and second locking mechanisms 1738 and 1740 to flex inward as they are inserted into inwardly recessed pockets 1738*b* and 1740*b*, respectively. Once the extending latching portions 1738*a* and 1740*a* are secured within the inwardly recessed pockets 1738*b* and 1740*b*, the extending latching portions 1738*a* and 1740*a* expand (or spring) back to their initial position and the extending latching portions are captured by protrusions (described above) of inwardly recessed pockets 1738*b* and 1740*b* creating a tighter fit and preventing the lid 1704 from being easily disengaged from the base 1702. The inwardly recessed pockets 1738*b* and 1740*b* may include a plurality of vertical pillars 1759 (described in detail below).

Figure 20:
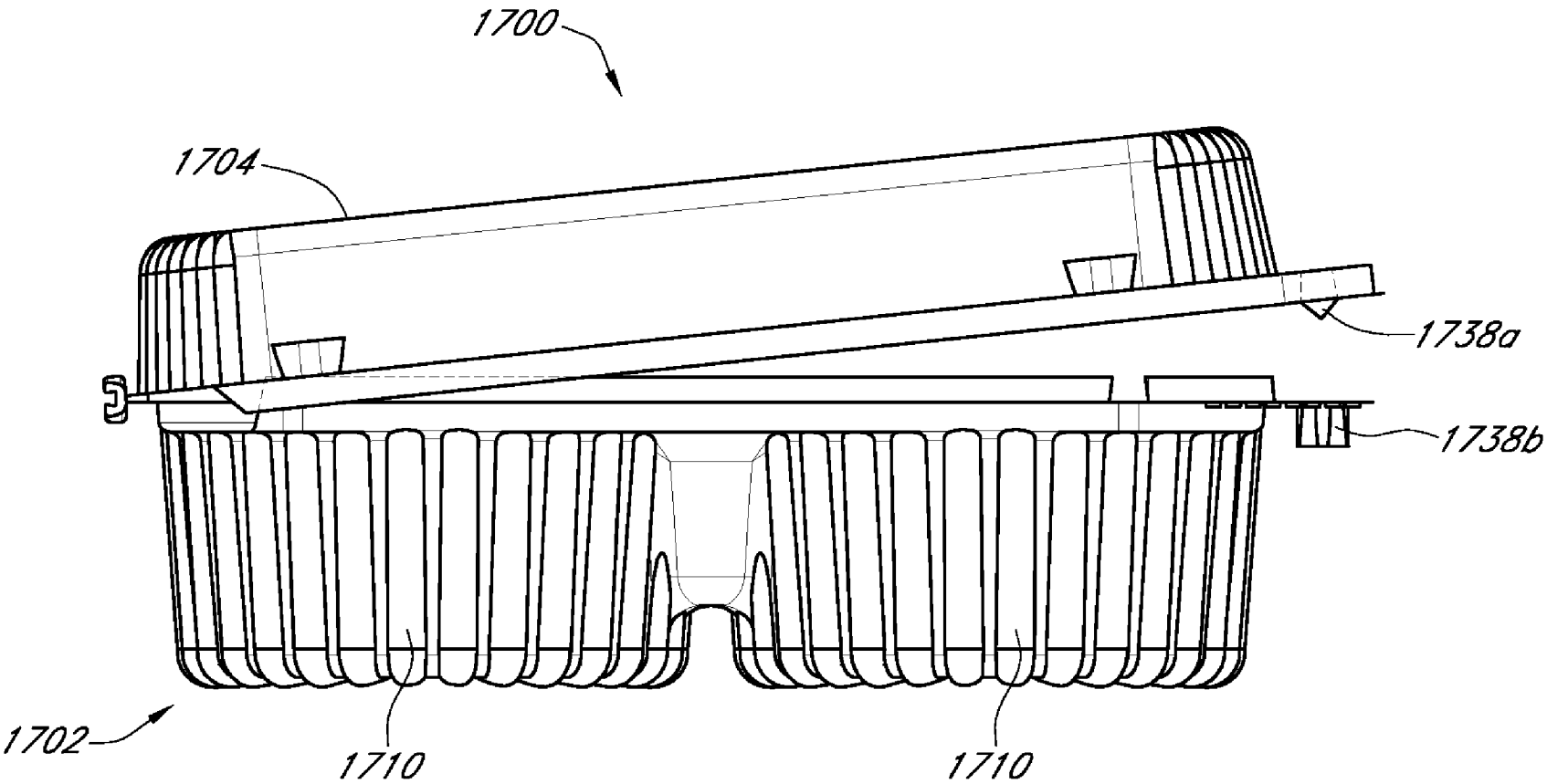
FIG. 20 illustrates a side elevational view of the container of FIG. 17, showing the lid aligned with and in an elevated position displaced from the base.

FIG. 20 illustrates a side elevational view of the container in FIG. 17, showing the lid 1702 aligned with and in an elevated position displaced from the base 1704.

Figure 21:
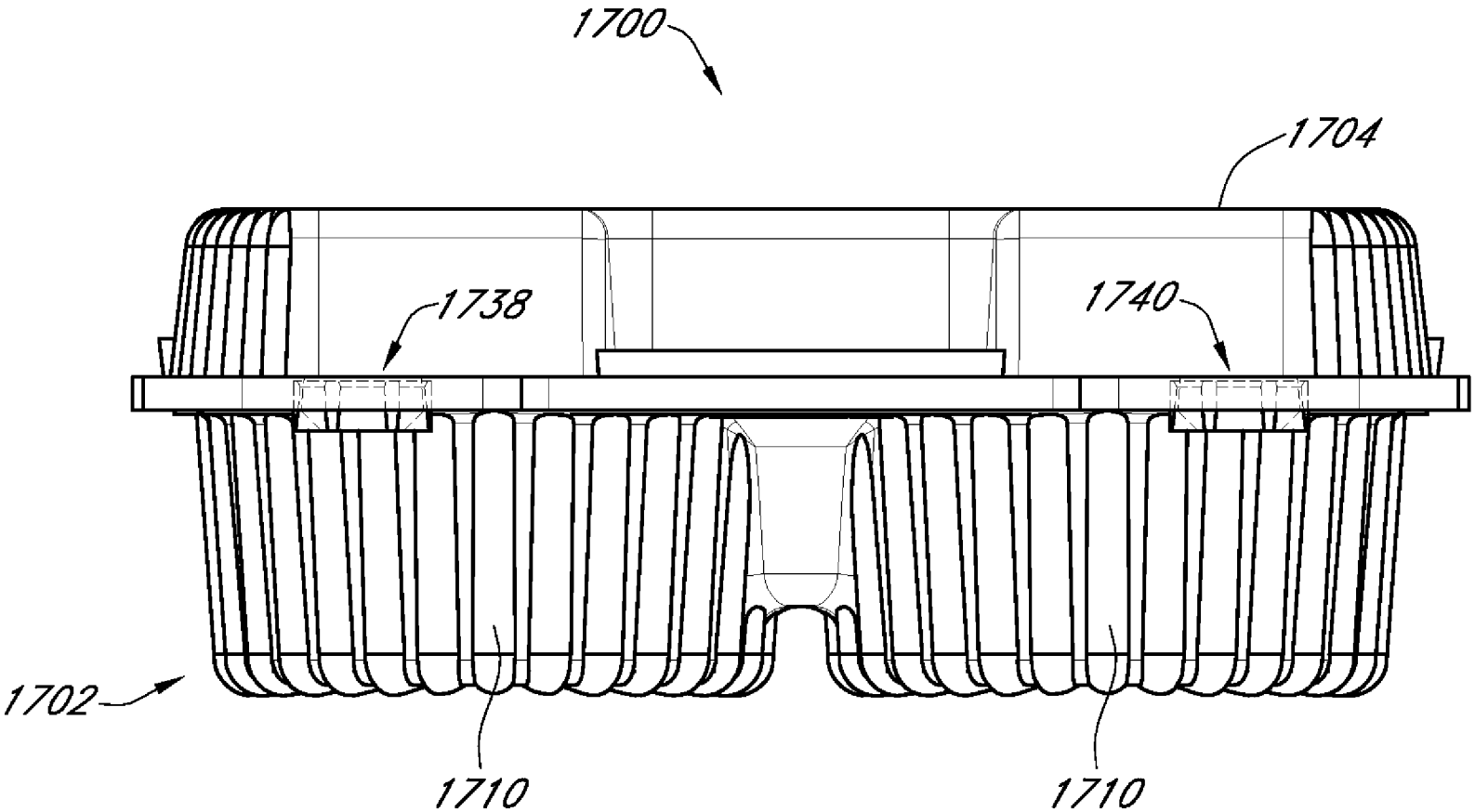
FIG. 21 illustrates a front elevational view of the container of FIG. 17, in a closed configuration.
Figure 22:
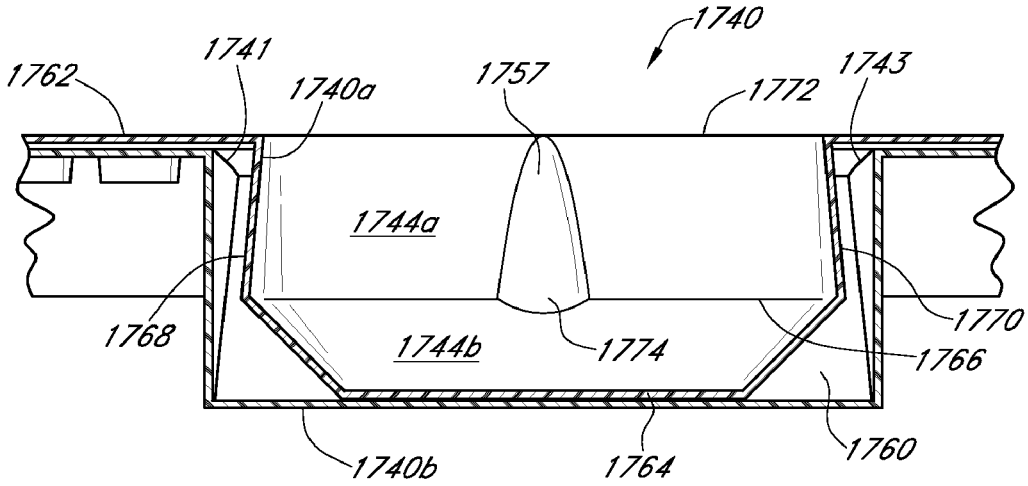
FIG. 22 illustrates a partial cross-sectional view of a locking mechanism taken along line 22-22 of FIG. 19.

FIG. 21 illustrates a front elevational view of the container of FIG. 17, in a closed configuration FIG. 22 illustrates a partial cross-sectional view of the second locking mechanism 1740 taken along line 22-22 of FIG. 19. As described above, the second locking mechanism 1740 may include an extending latching portion 1740*a* which is received by the inwardly recessed pocket 1740*b*. When engaged, the extending latching portion 1740*a* and the inwardly recessed pocket 1740*b* snap together, securely holding the lid and base of the container 1700 together and providing rigidity to the container. The inwardly recessed pocket 1740*b* includes an inner receiving cavity 1760 for receiving the extending latching portion 1740*a*.

The extending latching portion 1740*a* may have a lower portion 1744*a* and an upper portion 1744*b*, the lower portion 1744*a* integrally formed into the upper flange 1762. The lower portion 1744*a* may have an oval shaped configuration having a pair of end sections and a pair of side sections, and the upper portion 1744*b* having rounded ends and downwardly tapering sides that form a slightly rounded edge 1764. The lower portion 1744*a* and the upper portion 1744*b* are separated by a connecting ring 1766.

The edge 1764 allows the extending latching portion 1740*a* to guide itself into the inwardly recessed pocket 1740*b* if the lid and the base are not properly aligned when the lid and the base are pinched, pushed or rolled together to lock or engage the lid to the base and thus preventing the requirement of having direct alignment.

The extending latching portion 1740*a* may further include an inner facing groove 1756 and an outer facing groove (not shown). The grooves allow the end sections of the extending latching portion 1740*a* to flex inward allowing the connecting ring 1766 on the extending latching portion 1740*a* to slip past protrusions 1741 and 1743 of the inwardly recessed pocket 1740*b*. Once the extending latching portion 1740*a* is captured within the inwardly recessed pocket 1740*b*, the extending latching portion 1740*a* expands (or springs) back to its initial position and the extending latching portion 1740*a* is captured by the protrusions 1741 and 1743 (described above) of the inwardly recessed pocket 1740*b* creating a tighter fit, by providing negative interference, and preventing the lid 1704 from being easily disengaged from the base 1702

The extending latching portion 1740*a* may be inserted into the inwardly recessed pocket 1740*b* until the upper flange 1762 of the container 1700 abuts the top of the protrusions 1741 and 1743 of the inwardly recessed pocket 1740*b*. The sides 1768 and 1770 of the extending latching portion 1740*a* extend downwardly, flaring outwardly, from the upper flange 1762, such that the distance between the two sides increases slightly until reaching the connecting ring 1766. From the connecting ring 1766, the sides 1768 and 1770 taper inwards creating the upper portion 1744*b* of the extending latching portion 1740*a*.

The concave groove 1756 extends from the top 1772 of the extending latching portion 1740*a* to slightly below the connecting ring 1766. The width of the groove 1756 increases as it reaches the connecting ring 1766. From the connecting ring 1766, the bottom 1774 of the groove 1766 may form a convex dome.

Figure 23:
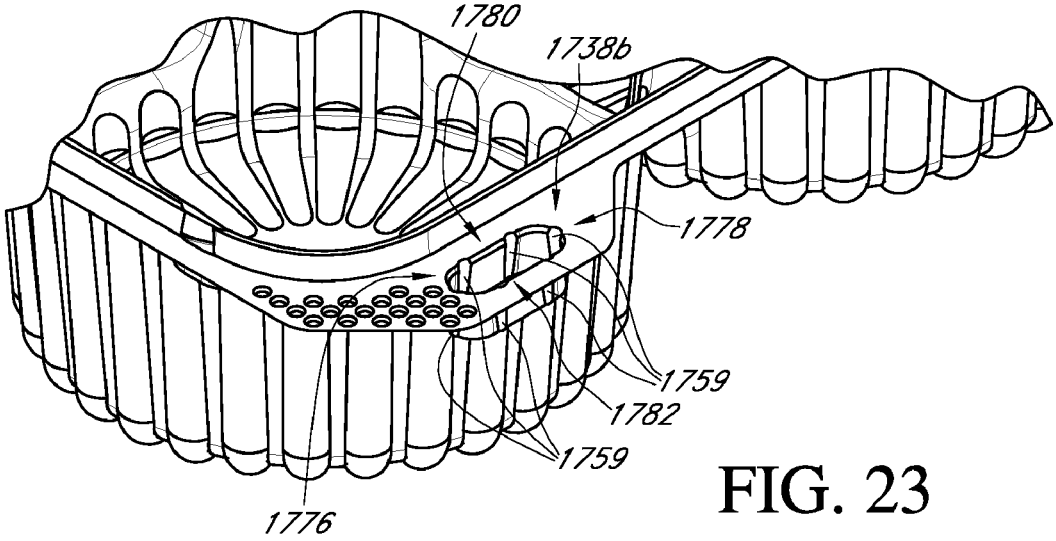
FIG. 23 illustrates a fragmentary view of the base of the container of FIG. 17.

FIG. 23 illustrates a fragmentary view of the base 1704 of the container of FIG. 17 showing the inwardly recessed pocket 1740*b*. The inwardly recessed pocket 1740*b* may include a plurality of vertical pillars 1759 creating side gussets. The plurality of vertical pillars 1759 may extend in a generally upwardly direction from bottom surface 1764 of the inwardly recessed pocket 1740*b* to the lower flange 1732, to strengthen the inwardly recessed pocket 1740*b*. The plurality of pillars 1759 may be formed integrally with the inwardly recessed pocket 1740*b*. In one embodiment, the inwardly recessed pocket 1740*b* may include six (6) pillars that may be symmetrically spaced about the inwardly recessed pocket. For example, two (2) pillars may be located on the end portions 1776 and 1778 of the inwardly recessed pocket 1740*b* and two (2) pillars may be located on each side 1780 and 1782 of the inwardly recessed pocket 1740*b*. (See FIG. 19) Although six (6) pillars are shown, this is by way of example only and the inwardly recessed pocket 1740*b* may include more or less pillars. By including a plurality of pillars 1759 on the inwardly recessed pocket 1740*b* may increase the strength of the inwardly recessed pocket 1740*b* so that when the extending latch portion 1740*b* is inserted or pushed into the inwardly recessed pocket 1740*b*, the inwardly recessed pocket 1740*b* will not be crushed as a result of the column strength of the pillars. Consequently, whether the container is being closed manually or automatically by a series of rollers, the inwardly recessed pocket 1740*b* will not collapse.

Figure 24:
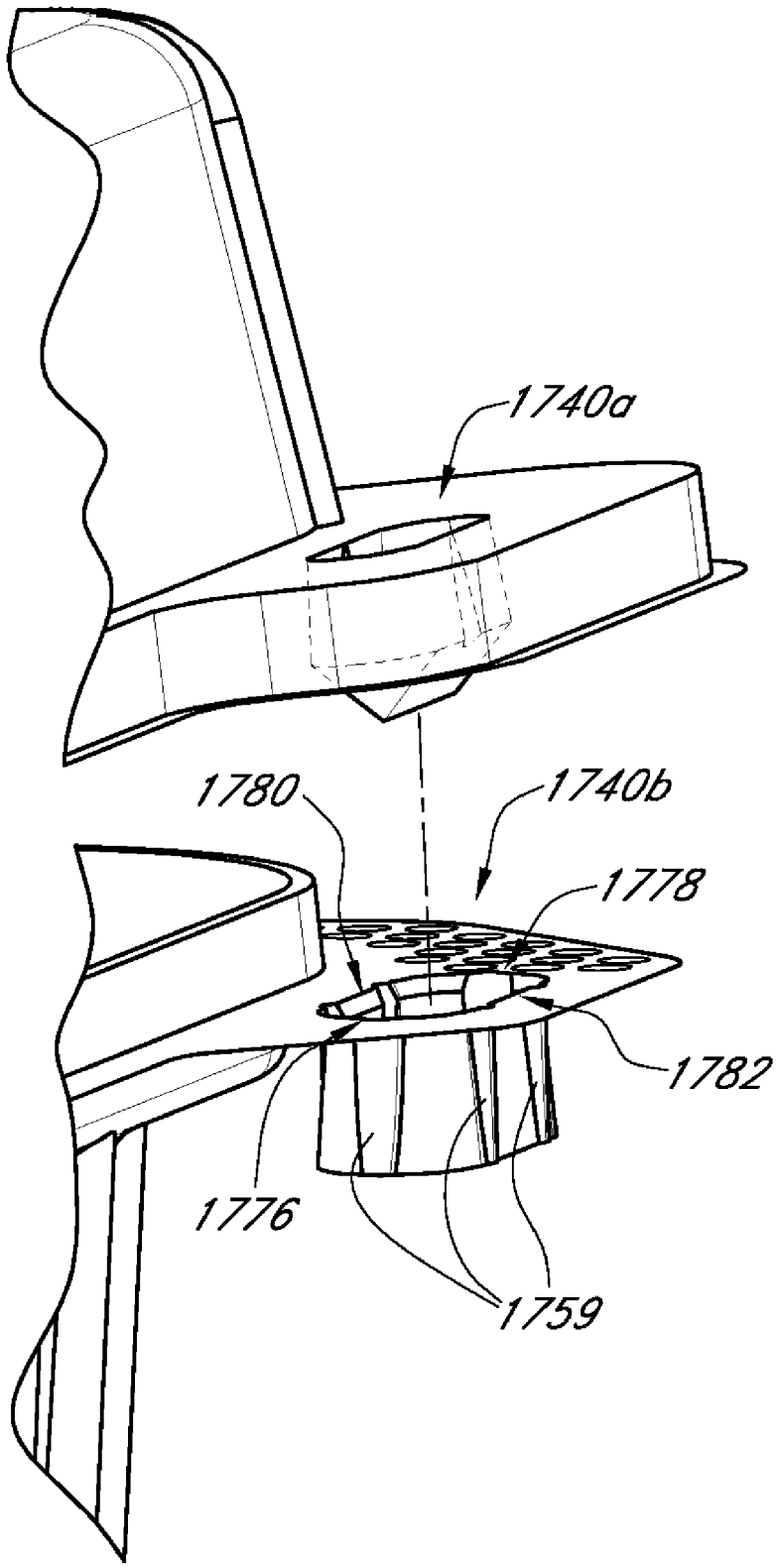
FIG. 24 illustrates a fragmentary view of a locking mechanism of the container of FIG. 17.

FIG. 24 illustrates a fragmentary view of the second locking mechanism 1740 of the container of FIG. 17.

One or more of the components and functions illustrated in FIGS. 1, 2, 3, 4, 5, 6, 7, 8, 9, 10, 11, 12, 13, 14, 15, 16, 17, 18, 19, 20, 21, 22, 23 and/or 24 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A locking mechanism for a container, comprising:

at least one inwardly recessed pocket having a plurality of vertical pillars extending in a generally upward vertical direction from a bottom surface of the at least one inwardly recessed pocket; and at least one extending latching portion for insertion into the at least one inwardly recessed pocket, the at least one extending latching portion comprising:

a lower portion, the lower portion comprising:

a pair of lower end sections;

a pair of lower side sections integrally connected to the pair of lower end sections, each lower side section of the pair of lower side sections having a concave groove located parallel to and equidistant from the pair of lower end sections;

an upper portion integrally connected to the lower portion, the upper portion comprising:

a pair of upper end sections integrally connected to the pair of lower end sections; and a pair of upper side sections integrally connected to the pair of lower side sections, each of the upper side sections of the pair of upper side sections tapering inwardly converging into a rounded top edge.

2. The locking mechanism of claim 1, wherein the lower portion has an oval shaped configuration.

3. The locking mechanism of claim 2, wherein the upper portion and the lower portion are separated by a ring.

4. The locking mechanism of claim 2, wherein the concave grooves allow the pair of lower end sections to flex inwards as the at least one extending latching portion is inserted into the at least one inwardly recessed pocket.

5. The locking mechanism of claim 4, wherein the at least one extending latching portion expands back to an initial position after the at least one extending latching portion is inserted into the at least one inwardly recessed pocket.

6. The locking mechanism of claim 5, wherein the at least one inwardly recessed pocket includes a protrusion formed integrally with an upper innermost circumference of the at least one inwardly recessed pocket.

7. The locking mechanism of claim 6, wherein the at least one extending latching portion is captured by the protrusion securing the lid to the base.

8. The locking mechanism of claim 1, wherein the plurality of vertical pillars are formed integrally with the at least one inwardly recessed pocket.

9. The locking mechanism of claim 1, wherein the least one inwardly recessed pocket has an oval shaped configuration and the plurality of vertical pillars are spaced equidistantly around the at least one inwardly recessed pocket.

10. A locking mechanism for a container, comprising:

an inwardly recessed pocket having a plurality of vertical pillars extending in a generally upwardly direction from a bottom surface of the inwardly recessed pocket; and an extending latching portion for insertion into the inwardly recessed pocket, the extending latching portion comprising:

an upper portion having a pair of upper rounded ends integrally connected to a pair of downwardly tapering upper side walls converging into a rounded edge;

a lower portion, integrally connected to the upper portion, having a pair of lower rounded end walls integrally connected to a pair of lower side walls;

a first concave groove extending vertically through a first lower side wall of the pair of lower side walls, perpendicular to the rounded edge; and a second concave groove extending vertically through a second lower side wall of the pair of lower side walls, perpendicular to the rounded edge.

11. The locking mechanism of claim 10, wherein the rounded edge allows the extending latching portion to self guide into the inwardly recessed pocket.

12. The locking mechanism of claim 10, wherein the first and second concave grooves allow the pair of lower rounded end walls to flex inwards as the extending latching portion is inserted into the inwardly recessed pocket.

13. The locking mechanism of claim 12, wherein the first and second concave grooves are located parallel to and equidistant from the pair of lower end sections and wherein the the first and second concave grooves extend into the upper portion.

14. The locking mechanism of claim 12, wherein the inwardly recessed pocket has an oval shaped configuration and the plurality of vertical pillars are spaced equidistantly around the inwardly recessed pocket.

15. A container, comprising:

a base having a pair of inwardly recessed pockets, each pocket in the pair of inwardly recessed pockets having an oval shaped configuration and a plurality of vertical pillars extending in a generally upwardly direction from a bottom surface of, and spaced equidistantly around, the each pocket in the pair of inwardly recessed pockets; and a lid hingedly connected to the base, the lid comprising:

a center portion;

an upper flange integrally connected to the center portion; and a pair of extending latching portions, integrally connected to the upper flange, the pair of extending latching portions having an inner concave grooves and opposing outer concave grooves, the inner and outer concave grooves, extending perpendicular to the upper flange, allowing the pair of extending latching portions to flex inwards as the pair of extending latching portions are inserted into the pair of inwardly recessed pockets, the pair of extending portions expand back to an initial position and the pair of extending latching portions is captured by the protrusions within the pair of inwardly recessed pockets securing the lid to the base.

* * * * *